US008403529B2

(12) United States Patent
Harbers

(10) Patent No.: US 8,403,529 B2
(45) Date of Patent: Mar. 26, 2013

(54) LED-BASED ILLUMINATION MODULE WITH PREFERENTIALLY ILLUMINATED COLOR CONVERTING SURFACES

(75) Inventor: Gerard Harbers, Sunnyvale, CA (US)

(73) Assignee: Xicato, Inc., San Jose, CA (US)

( * ) Notice: Subject to any disclaimer, the term of this patent is extended or adjusted under 35 U.S.C. 154(b) by 0 days.

(21) Appl. No.: 13/560,830

(22) Filed: Jul. 27, 2012

(65) Prior Publication Data

US 2012/0287624 A1 Nov. 15, 2012

Related U.S. Application Data

(60) Provisional application No. 61/514,233, filed on Aug. 2, 2011.

(51) Int. Cl.
*F21V 9/16* (2006.01)
*F21V 9/08* (2006.01)

(52) U.S. Cl. ..... 362/241; 257/98; 257/99

(58) Field of Classification Search ..... 362/373, 362/800, 294, 650, 249, 245, 241, 247; 315/312, 315/292, 297, 149; 313/484–487, 489, 498, 313/512, 467, 468, 499, 501–503; 257/98–100, 257/79–81

See application file for complete search history.

(56) References Cited

U.S. PATENT DOCUMENTS 5,959,316 A 9/1999 Lowery
6,351,069 B1 2/2002 Lowery et al.
6,504,301 B1 1/2003 Lowery
6,586,882 B1 7/2003 Harbers
6,600,175 B1 7/2003 Baretz et al.
6,680,569 B2 1/2004 Mueller-Mach et al.
6,812,500 B2 11/2004 Reeh et al.
7,126,162 B2 10/2006 Reeh et al.
7,250,715 B2 7/2007 Mueller et al.
7,479,662 B2 1/2009 Soules et al.
7,564,180 B2 7/2009 Brandes
7,614,759 B2 11/2009 Negley
7,629,621 B2 12/2009 Reeh et al.
7,942,540 B2 5/2011 Harbers et al.
2007/0081336 A1 4/2007 Bierhuizen et al.
2008/0310158 A1* 12/2008 Harbers et al. ..... 362/240
2009/0103293 A1* 4/2009 Harbers et al. ..... 362/231
2009/0103296 A1 4/2009 Harbers et al.

OTHER PUBLICATIONS

U.S. Appl. No. 13/560,827, filed on Jul. 27, 2012 by Xicato, Inc., 66 pages.

* cited by examiner

*Primary Examiner* — Anh Mai
*Assistant Examiner* — Elmito Breval
(74) *Attorney, Agent, or Firm* — Silicon Valley Patent Group LLP

(57) ABSTRACT

An illumination module includes a color conversion cavity with multiple interior surfaces, such as sidewalls and an output window. A shaped reflector is disposed above a mounting board upon which are mounted LEDs. The shaped reflector includes a first plurality of reflective surfaces that preferentially direct light emitted from a first LED to a first interior surface of the color conversion cavity and a second plurality of reflective surfaces that preferentially direct light emitted from a second LED to a second interior surface. The illumination module may further include a second color conversion cavity.

26 Claims, 13 Drawing Sheets

LED-BASED ILLUMINATION MODULE WITH PREFERENTIALLY ILLUMINATED COLOR CONVERTING SURFACES

CROSS REFERENCE TO RELATED APPLICATIONS

This application claims priority under 35 USC 119 to U.S. Provisional Application No. 61/514,233, filed Aug. 2, 2011, which is incorporated by reference herein in its entirety.

TECHNICAL FIELD

The described embodiments relate to illumination modules that include Light Emitting Diodes (LEDs).

BACKGROUND

The use of light emitting diodes in general lighting is still limited due to limitations in light output level or flux generated by the illumination devices. Illumination devices that use LEDs also typically suffer from poor color quality characterized by color point instability. The color point instability varies over time as well as from part to part. Poor color quality is also characterized by poor color rendering, which is due to the spectrum produced by the LED light sources having bands with no or little power. Further, illumination devices that use LEDs typically have spatial and/or angular variations in the color. Additionally, illumination devices that use LEDs are expensive due to, among other things, the necessity of required color control electronics and/or sensors to maintain the color point of the light source or using only a small selection of produced LEDs that meet the color and/or flux requirements for the application.

Consequently, improvements to illumination device that uses light emitting diodes as the light source are desired.

SUMMARY

An illumination module includes a color conversion cavity with multiple interior surfaces, such as sidewalls and an output window. A shaped reflector is disposed above a mounting board upon which are mounted LEDs. The shaped reflector includes a first plurality of reflective surfaces that preferentially direct light emitted from a first LED to a first interior surface of the color conversion cavity and a second plurality of reflective surfaces that preferentially direct light emitted from a second LED to a second interior surface. The illumination module may further include a second color conversion cavity.

Further details and embodiments and techniques are described in the detailed description below. This summary does not define the invention. The invention is defined by the claims.

DETAILED DESCRIPTION

Reference will now be made in detail to background examples and some embodiments of the invention, examples of which are illustrated in the accompanying drawings.

Figure 1:
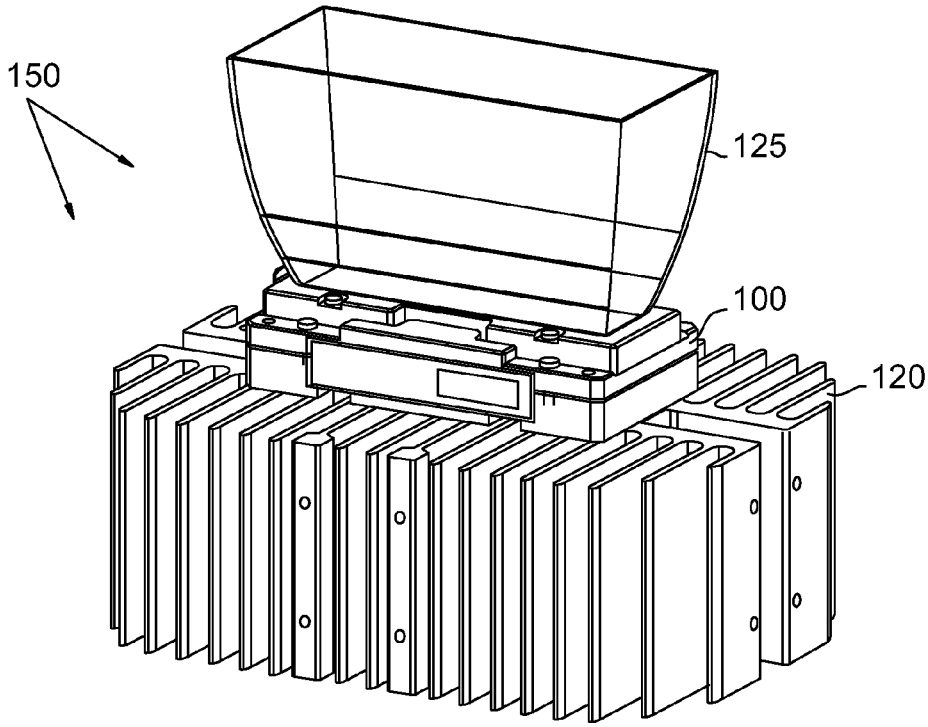
FIGS. 1, 2, and 3 illustrate three exemplary luminaires, including an illumination device, reflector, and light fixture.
Figure 2:
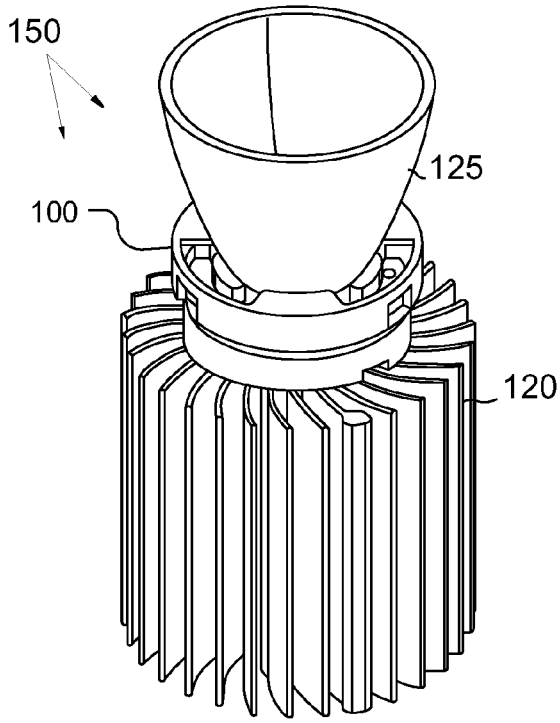
Figure 3:
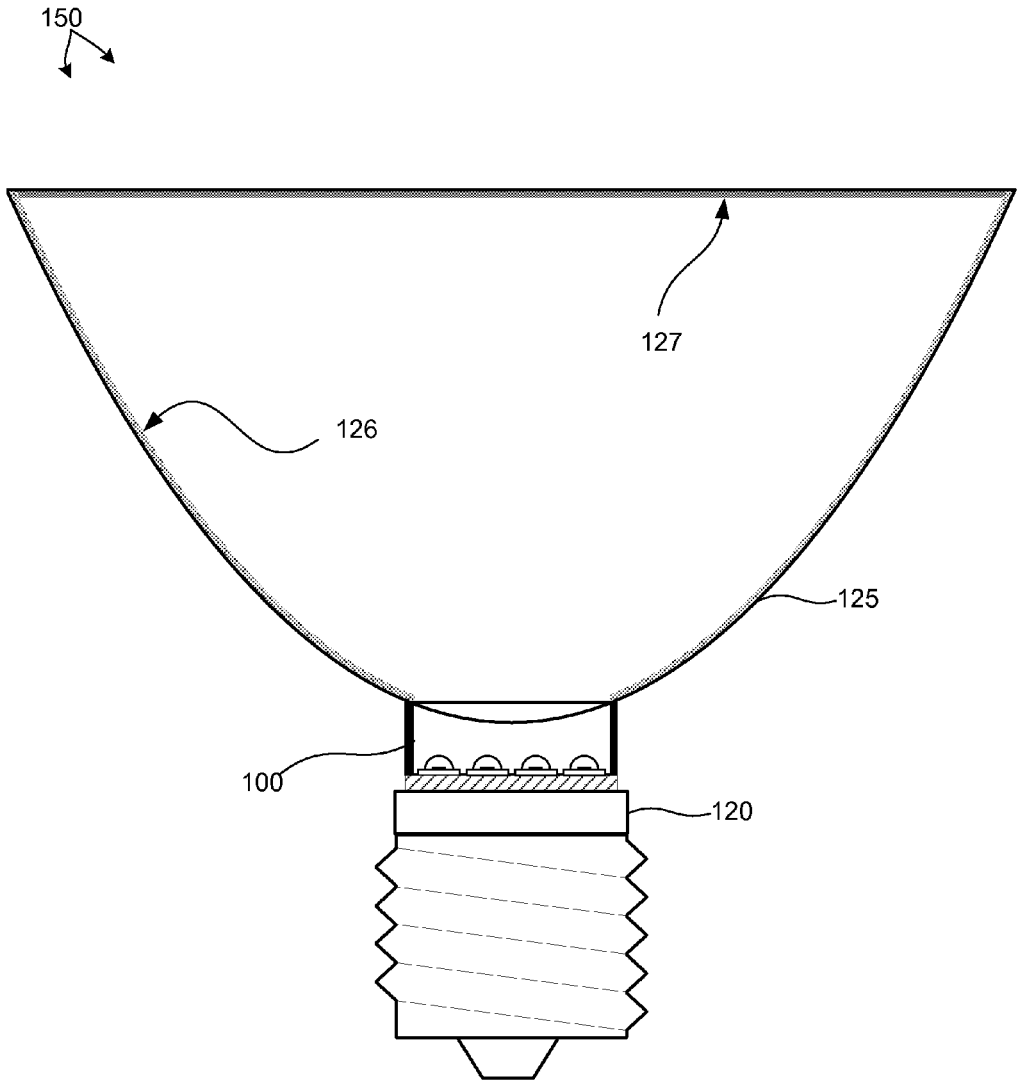

FIGS. 1, 2, and 3 illustrate three exemplary luminaires, all labeled 150. The luminaire illustrated in FIG. 1 includes an illumination module 100 with a rectangular form factor. The luminaire illustrated in FIG. 2 includes an illumination module 100 with a circular form factor. The luminaire illustrated in FIG. 3 includes an illumination module 100 integrated into a retrofit lamp device. These examples are for illustrative purposes. Examples of illumination modules of general polygonal and elliptical shapes may also be contemplated. Luminaire 150 includes illumination module 100, reflector 125, and light fixture 120. As depicted, light fixture 120 includes a heat sink capability, and therefore may be sometimes referred to as heat sink 120. However, light fixture 120 may include other structural and decorative elements (not shown). Reflector 125 is mounted to illumination module 100 to collimate or deflect light emitted from illumination module 100. The reflector 125 may be made from a thermally conductive material, such as a material that includes aluminum or copper and may be thermally coupled to illumination module 100. Heat flows by conduction through illumination module 100 and the thermally conductive reflector 125. Heat also flows via thermal convection over the reflector 125. Reflector 125 may be a compound parabolic concentrator, where the concentrator is constructed of or coated with a highly reflecting material. Optical elements, such as a diffuser or reflector 125 may be removably coupled to illumination module 100, e.g., by means of threads, a clamp, a twist-lock mechanism, or other appropriate arrangement. As illustrated in FIG. 3, the reflector 125 may include sidewalls 126 and a window 127 that are optionally coated, e.g., with a wavelength converting material, diffusing material or any other desired material.

As depicted in FIGS. 1, 2, and 3, illumination module 100 is mounted to heat sink 120. Heat sink 120 may be made from a thermally conductive material, such as a material that includes aluminum or copper and may be thermally coupled to illumination module 100. Heat flows by conduction through illumination module 100 and the thermally conductive heat sink 120. Heat also flows via thermal convection over heat sink 120. Illumination module 100 may be attached to heat sink 120 by way of screw threads to clamp the illumination module 100 to the heat sink 120. To facilitate easy removal and replacement of illumination module 100, illumination module 100 may be removably coupled to heat sink 120, e.g., by means of a clamp mechanism, a twist-lock mechanism, or other appropriate arrangement. Illumination module 100 includes at least one thermally conductive surface that is thermally coupled to heat sink 120, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 120 may permit the LEDs 102 to be driven at higher power, and also allows for different heat sink designs. For example, some designs may exhibit a cooling capacity that is less dependent on the orientation of the heat sink. In addition, fans or other solutions for forced cooling may be used to remove the heat from the device. The bottom heat sink may include an aperture so that electrical connections can be made to the illumination module 100.

Figure 4:
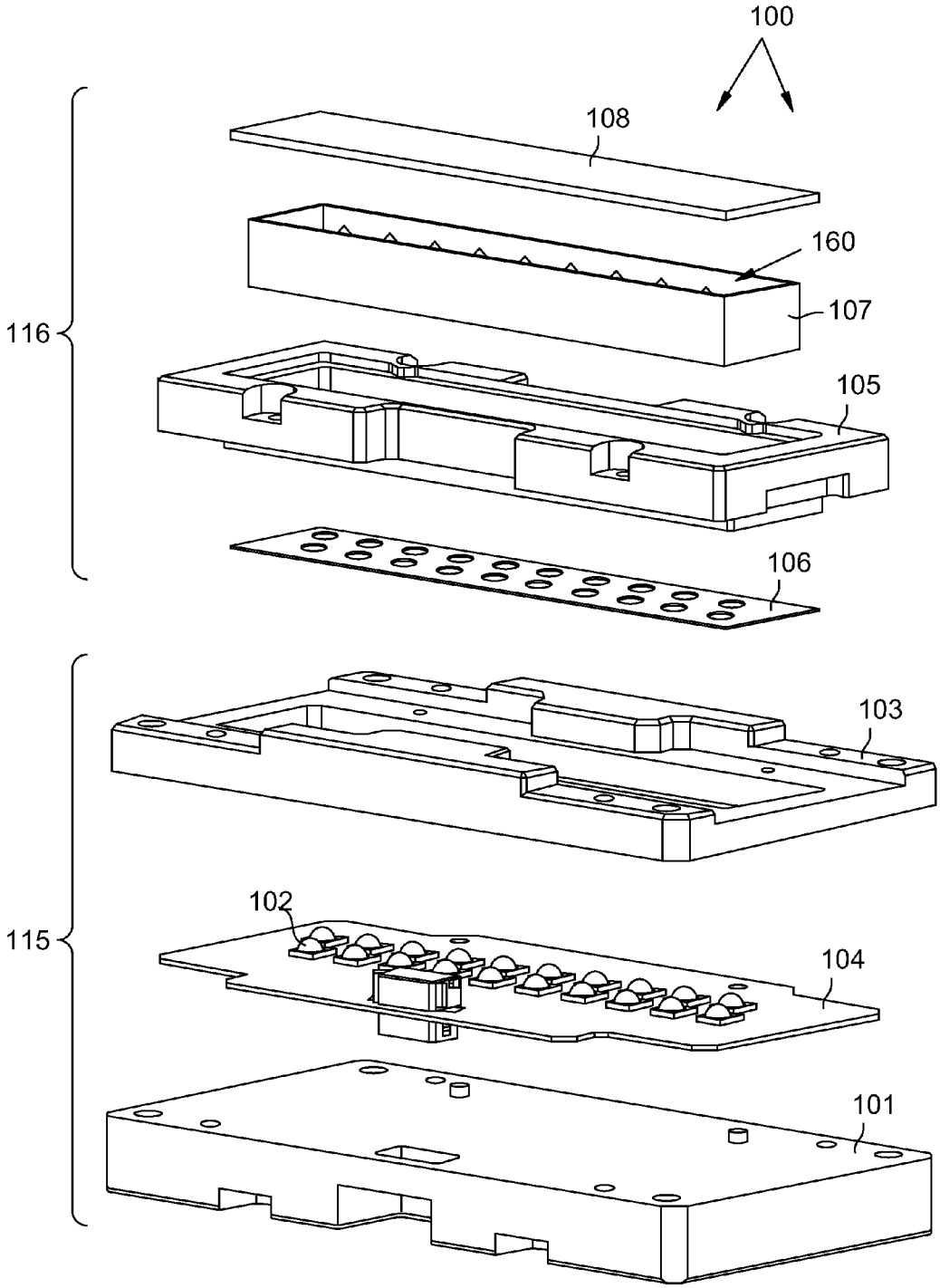
FIG. 4 illustrates an exploded view of components of the LED based illumination module depicted in FIG. 1.

FIG. 4 illustrates an exploded view of components of LED based illumination module 100 as depicted in FIG. 1 by way of example. It should be understood that as defined herein an LED based illumination module is not an LED, but is an LED light source or fixture or component part of an LED light source or fixture. For example, an LED based illumination module may be an LED based replacement lamp such as depicted in FIG. 3. LED based illumination module 100 includes one or more LED die or packaged LEDs and a mounting board to which LED die or packaged LEDs are attached. In one embodiment, the LEDs 102 are packaged LEDs, such as the Luxeon Rebel manufactured by Philips Lumileds Lighting. Other types of packaged LEDs may also be used, such as those manufactured by OSRAM (Oslon package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. Mounting board 104 is attached to mounting base 101 and secured in position by mounting board retaining ring 103. Together, mounting board 104 populated by LEDs 102 and mounting board retaining ring 103 comprise light source sub-assembly 115. Light source sub-assembly 115 is operable to convert electrical energy into light using LEDs 102. The light emitted from light source sub-assembly 115 is directed to light conversion sub-assembly 116 for color mixing and color conversion. Light conversion sub-assembly 116 includes cavity body 105 and an output port, which is illustrated as, but is not limited to, an output window 108. Light conversion sub-assembly 116 includes a bottom reflector 106 and sidewall 107, which may optionally be formed from inserts. Output window 108, if used as the output port, is fixed to the top of cavity body 105. In some embodiments, output window 108 may be fixed to cavity body 105 by an adhesive. To promote heat dissipation from the output window to cavity body 105, a thermally conductive adhesive is desirable. The adhesive should reliably withstand the temperature present at the interface of the output window 108 and cavity body 105. Furthermore, it is preferable that the adhesive either reflect or transmit as much incident light as possible, rather than absorbing light emitted from output window 108. In one example, the combination of heat tolerance, thermal conductivity, and optical properties of one of several adhesives manufactured by Dow Corning (USA) (e.g., Dow Corning model number SE4420, SE4422, SE4486, 1-4173, or SE9210), provides suitable performance. However, other thermally conductive adhesives may also be considered.

Either the interior sidewalls of cavity body 105 or sidewall insert 107, when optionally placed inside cavity body 105, is reflective so that light from LEDs 102, as well as any wavelength converted light, is reflected within the cavity 160 until it is transmitted through the output port, e.g., output window 108 when mounted over light source sub-assembly 115. Bottom reflector insert 106 may optionally be placed over mounting board 104. Bottom reflector insert 106 includes holes such that the light emitting portion of each LED 102 is not blocked by bottom reflector insert 106. Sidewall insert 107 may optionally be placed inside cavity body 105 such that the interior surfaces of sidewall insert 107 direct light from the LEDs 102 to the output window when cavity body 105 is mounted over light source sub-assembly 115. Although as depicted, the interior sidewalls of cavity body 105 are rectangular in shape as viewed from the top of illumination module 100, other shapes may be contemplated (e.g., clover shaped or polygonal). In addition, the interior sidewalls of cavity body 105 may taper or curve outward from mounting board 104 to output window 108, rather than perpendicular to output window 108 as depicted.

Bottom reflector insert 106 and sidewall insert 107 may be highly reflective so that light reflecting downward in the cavity 160 is reflected back generally towards the output port, e.g., output window 108. Additionally, inserts 106 and 107 may have a high thermal conductivity, such that it acts as an additional heat spreader. By way of example, the inserts 106 and 107 may be made with a highly thermally conductive material, such as an aluminum based material that is processed to make the material highly reflective and durable. By way of example, a material referred to as Miro®, manufactured by Alanod, a German company, may be used. High reflectivity may be achieved by polishing the aluminum, or by covering the inside surface of inserts 106 and 107 with one or more reflective coatings. Inserts 106 and 107 might alternatively be made from a highly reflective thin material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In other examples, inserts 106 and 107 may be made from a polytetrafluoroethylene PTFE material. In some examples inserts 106 and 107 may be made from a PTFE material of one to two millimeters thick, as sold by W.L. Gore (USA) and Berghof (Germany). In yet other embodiments, inserts 106 and 107 may be constructed from a PTFE material backed by a thin reflective layer such as a metallic layer or a non-metallic layer such as ESR, E60L, or MCPET. Also, highly diffuse reflective coatings can be applied to any of sidewall insert 107, bottom reflector insert 106, output window 108, cavity body 105, and mounting board 104. Such coatings may include titanium dioxide (TiO2), zinc oxide (ZnO), and barium sulfate (BaSO4) particles, or a combination of these materials.

Figure 5A:
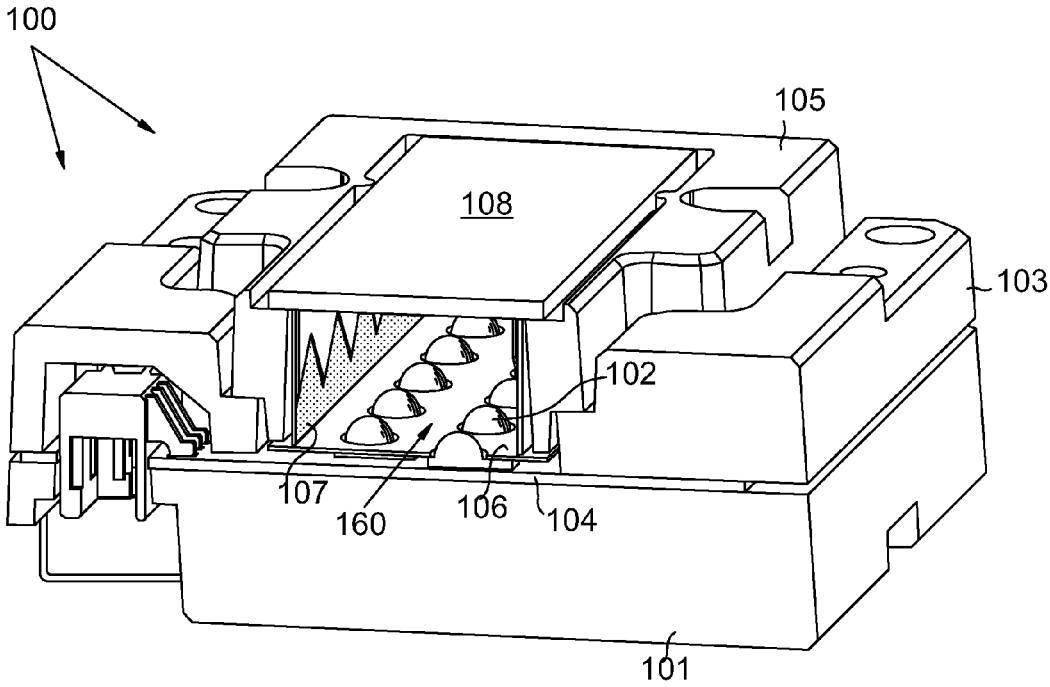
FIGS. 5A and 5B illustrate perspective, cross-sectional views of the LED based illumination module depicted in FIG. 1.
Figure 5B:
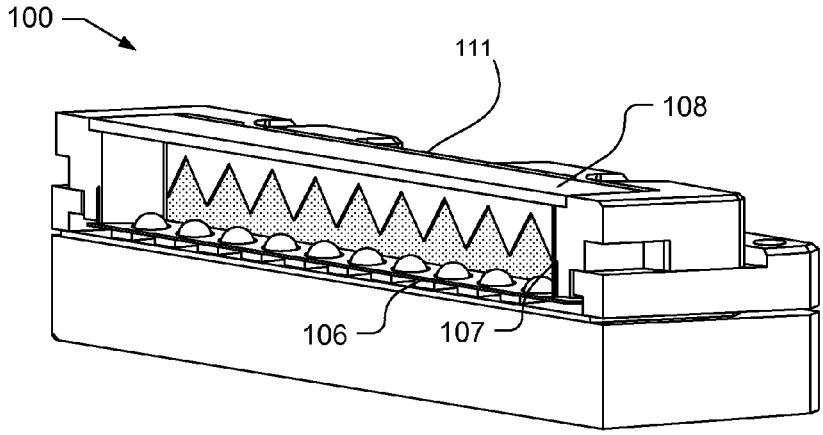

FIGS. 5A and 5B illustrate perspective, cross-sectional views of LED based illumination module 100 as depicted in FIG. 1. In this embodiment, the sidewall insert 107, output window 108, and bottom reflector insert 106 disposed on mounting board 104 define a color conversion cavity 160 (illustrated in FIG. 5A) in the LED based illumination module 100. A portion of light from the LEDs 102 is reflected within color conversion cavity 160 until it exits through output window 108. Reflecting the light within the cavity 160 prior to exiting the output window 108 has the effect of mixing the light and providing a more uniform distribution of the light that is emitted from the LED based illumination module 100. In addition, as light reflects within the cavity 160 prior to exiting the output window 108, an amount of light is color converted by interaction with a wavelength converting material included in the cavity 160.

As depicted in FIGS. 1-5B, light generated by LEDs 102 is generally emitted into color conversion cavity 160. However, various embodiments are introduced herein to preferentially direct light emitted from specific LEDs 102 to specific interior surfaces of LED based illumination module 100. In this manner, LED based illumination module 100 includes preferentially stimulated color converting surfaces. In one aspect, a shaped base reflector includes a number of reflective surfaces that preferentially directs light emitted by certain LEDs 102 to an interior surface of color conversion cavity 160 that includes a first wavelength converting material and directs light emitted by other LEDs 102 to another interior surface of color conversion cavity 160 that includes a second wavelength converting material. In this manner effective color conversion may be achieved more efficiently than by generally flooding the interior surfaces of color conversion cavity 160 with light emitted from LEDs 102.

LEDs 102 can emit different or the same colors, either by direct emission or by phosphor conversion, e.g., where phosphor layers are applied to the LEDs as part of the LED package. The illumination module 100 may use any combination of colored LEDs 102, such as red, green, blue, amber, or cyan, or the LEDs 102 may all produce the same color light. Some or all of the LEDs 102 may produce white light. In addition, the LEDs 102 may emit polarized light or non-polarized light and LED based illumination module 100 may use any combination of polarized or non-polarized LEDs. In some embodiments, LEDs 102 emit either blue or UV light because of the efficiency of LEDs emitting in these wavelength ranges. The light emitted from the illumination module 100 has a desired color when LEDs 102 are used in combination with wavelength converting materials included in color conversion cavity 160. The photo converting properties of the wavelength converting materials in combination with the mixing of light within cavity 160 results in a color converted light output. By tuning the chemical and/or physical (such as thickness and concentration) properties of the wavelength converting materials and the geometric properties of the coatings on the interior surfaces of cavity 160, specific color properties of light output by output window 108 may be specified, e.g., color point, color temperature, and color rendering index (CRI).

For purposes of this patent document, a wavelength converting material is any single chemical compound or mixture of different chemical compounds that performs a color conversion function, e.g., absorbs an amount of light of one peak wavelength, and in response, emits an amount of light at another peak wavelength.

Portions of cavity 160, such as the bottom reflector insert 106, sidewall insert 107, cavity body 105, output window 108, and other components placed inside the cavity (not shown) may be coated with or include a wavelength converting material. FIG. 5B illustrates portions of the sidewall insert 107 coated with a wavelength converting material. Furthermore, different components of cavity 160 may be coated with the same or a different wavelength converting material.

By way of example, phosphors may be chosen from the set denoted by the following chemical formulas: Y3Al5O12:Ce, (also known as YAG:Ce, or simply YAG) (Y,Gd)3Al5O12:Ce, CaS:Eu, SrS:Eu, SrGa2S4:Eu, Ca3(Sc,Mg)2Si3O12:Ce, Ca3Sc2Si3O12:Ce, Ca3Sc2O4:Ce, Ba3Si6O12N2:Eu, (Sr, Ca)AlSiN3:Eu, CaAlSiN3:Eu, CaAlSi(ON)3:Eu, Ba2SiO4:Eu, Sr2SiO4:Eu, Ca2SiO4:Eu, CaSc2O4:Ce, CaSi2O2N2:Eu, SrSi2O2N2:Eu, BaSi2O2N2:Eu, Ca5(PO4)3Cl:Eu, Ba5(PO4)3Cl:Eu, Cs2CaP2O7, Cs2SrP2O7, Lu3Al5O12:Ce, Ca8Mg(SiO4)4Cl2:Eu, Sr8Mg(SiO4)4Cl2:Eu, La3Si6N11:Ce, Y3Ga5O12:Ce, Gd3Ga5O12:Ce, Tb3Al5O12:Ce, Tb3Ga5O12:Ce, and Lu3Ga5O12:Ce.

In one example, the adjustment of color point of the illumination device may be accomplished by replacing sidewall insert 107 and/or the output window 108, which similarly may be coated or impregnated with one or more wavelength converting materials. In one embodiment a red emitting phosphor such as a europium activated alkaline earth silicon nitride (e.g., (Sr,Ca)AlSiN3:Eu) covers a portion of sidewall insert 107 and bottom reflector insert 106 at the bottom of the cavity 160, and a YAG phosphor covers a portion of the output window 108. In another embodiment, a red emitting phosphor such as alkaline earth oxy silicon nitride covers a portion of sidewall insert 107 and bottom reflector insert 106 at the bottom of the cavity 160, and a blend of a red emitting alkaline earth oxy silicon nitride and a yellow emitting YAG phosphor covers a portion of the output window 108.

In some embodiments, the phosphors are mixed in a suitable solvent medium with a binder and, optionally, a surfactant and a plasticizer. The resulting mixture is deposited by any of spraying, screen printing, blade coating, or other suitable means. By choosing the shape and height of the sidewalls that define the cavity, and selecting which of the parts in the cavity will be covered with phosphor or not, and by optimization of the layer thickness and concentration of the phosphor layer on the surfaces of light mixing cavity 160, the color point of the light emitted from the module can be tuned as desired.

In one example, a single type of wavelength converting material may be patterned on the sidewall, which may be, e.g., the sidewall insert 107 shown in FIG. 5B. By way of example, a red phosphor may be patterned on different areas of the sidewall insert 107 and a yellow phosphor may cover the output window 108. The coverage and/or concentrations of the phosphors may be varied to produce different color temperatures. It should be understood that the coverage area of the red and/or the concentrations of the red and yellow phosphors will need to vary to produce the desired color temperatures if the light produced by the LEDs 102 varies. The color performance of the LEDs 102, red phosphor on the sidewall insert 107 and the yellow phosphor on the output window 108 may be measured before assembly and selected based on performance so that the assembled pieces produce the desired color temperature.

In many applications it is desirable to generate white light output with a correlated color temperature (CCT) less than 3,100 Kelvin. For example, in many applications, white light with a CCT of 2,700 Kelvin is desired. Some amount of red emission is generally required to convert light generated from LEDs emitting in the blue or UV portions of the spectrum to a white light output with a CCT less than 3,100 Kelvin. Efforts are being made to blend yellow phosphor with red emitting phosphors such as CaS:Eu, SrS:Eu, $SrGa_2S_4$:Eu, $Ba_3Si_6O_{12}N_2$:Eu, (Sr,Ca)$AlSiN_3$:Eu, $CaAlSiN_3$:Eu, CaAlSi$(ON)_3$:Eu, $Ba_2SiO_4$:Eu, $Sr_2SiO_4$:Eu, $Ca_2SiO_4$:Eu, $CaSi_2O_2N_2$:Eu, $SrSi_2O_2N_2$:Eu, $BaSi_2O_2N_2$:Eu, $Sr_8Mg(SiO_4)_4Cl_2$:Eu, $Li_2NbF_7$:$Mn^{4+}$, $Li_3ScF_6$:$Mn^{4+}$, $La_2O_2S$:$Eu^{3+}$ and $MgO.MgF_2.GeO_2$:$Mn^{4+}$ to reach required CCT. However, color consistency of the output light is typically poor due to the sensitivity of the CCT of the output light to the red phosphor component in the blend. Poor color distribution is more noticeable in the case of blended phosphors, particularly in lighting applications. By coating output window 108 with a phosphor or phosphor blend that does not include any red emitting phosphor, problems with color consistency may be avoided. To generate white light output with a CCT less than 3,100 Kelvin, a red emitting phosphor or phosphor blend is deposited on any of the sidewalls and bottom reflector of LED based illumination module 100. The specific red emitting phosphor or phosphor blend (e.g. peak wavelength emission from 600 nanometers to 700 nanometers) as well as the concentration of the red emitting phosphor or phosphor blend are selected to generate a white light output with a CCT less than 3,100 Kelvin. In this manner, an LED based illumination module may generate white light with a CCT less than 3,100K with an output window that does not include a red emitting phosphor component.

It is desirable for an LED based illumination module, to convert a portion of light emitted from the LEDs (e.g. blue light emitted from LEDs 102) to longer wavelength light in at least one color conversion cavity 160 while minimizing photon loses. Densely packed, thin layers of phosphor are suitable to efficiently color convert a significant portion of incident light while minimizing loses associated with reabsorption by adjacent phosphor particles, total internal reflection (TIR), and Fresnel effects.

Figure 6:
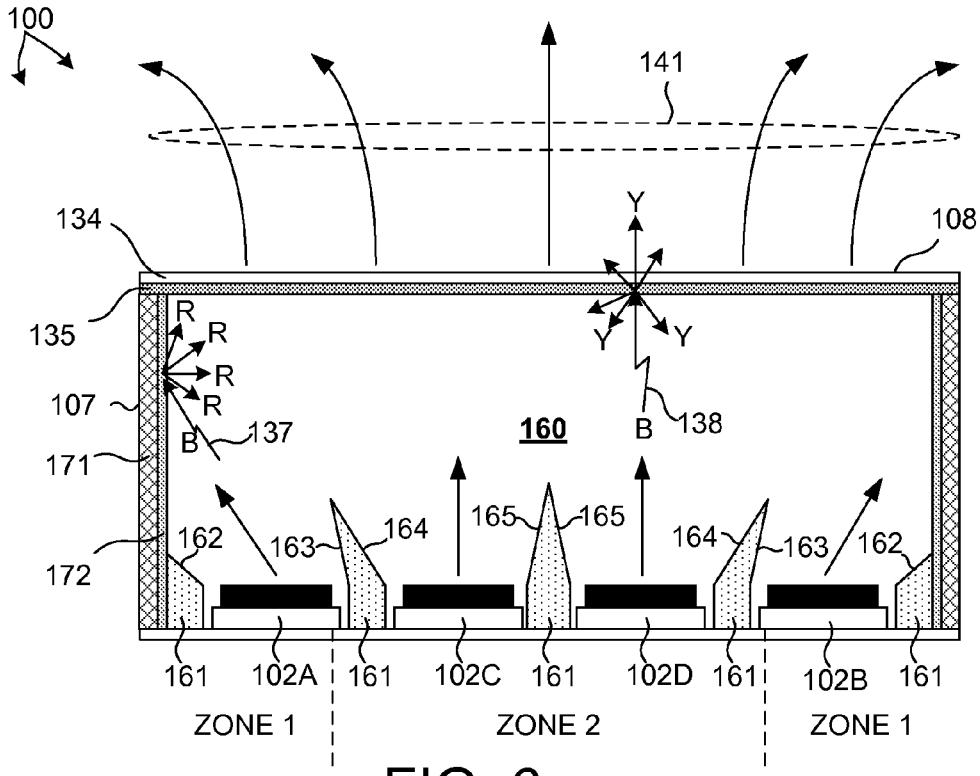
FIG. 6 is illustrative of a cross-sectional, side view of an LED based illumination module in one embodiment.

FIG. 6 is illustrative of a cross-sectional, side view of an LED based illumination module 100 in one embodiment. As illustrated, LED based illumination module 100 includes a plurality of LEDs 102A-102D, a sidewall 107, an output window 108, and a shaped reflector 161. Sidewall 107 includes a reflective layer 171 and a color converting layer 172. Color converting layer 172 includes a wavelength converting material (e.g., a red-emitting phosphor material). Output window 108 includes a transmissive layer 134 and a color converting layer 135. Color converting layer 135 includes a wavelength converting material with a different color conversion property than the wavelength converting material included in sidewall 107 (e.g., a yellow-emitting phosphor material). Color conversion cavity 160 is formed by the interior surfaces of the LED based illumination module 100 including the interior surface of sidewall 107 and the interior surface of output window 108.

The LEDs 102A-102D of LED based illumination module 100 emit light directly into color conversion cavity 160. Light is mixed and color converted within color conversion cavity 160 and the resulting combined light 141 is emitted by LED based illumination module 100.

As depicted in FIG. 6, shaped reflector 161 is included in LED based illumination module 100 as a bottom reflector insert 106. As such, shaped reflector 161 is placed over mounting board 104 and includes holes such that the light emitting portion of each LED 102 is not blocked by shaped reflector 161. Shaped reflector 161 may be constructed from metallic materials (e.g., aluminum) or non-metallic materials (e.g., PTFE, MCPET, high temperature plastics, etc.) formed by a suitable process (e.g., stamping, molding, compression molding, extrusion, die cast, etc.). Shaped reflector 161 may be constructed from one piece of material or from more than one piece of material joined together by a suitable process (e.g., welding, gluing, etc.).

In one aspect, shaped reflector 161 divides the LEDs 102 included in LED based illumination module 100 into different zones that preferentially illuminate different color converting surfaces of color conversion cavity 160. For example, as illustrated, some LEDs 102A and 102B are located in zone 1. Light emitted from LEDs 102A and 102B located in zone 1 preferentially illuminates sidewall 107 because LEDs 102A and 102B are positioned in close proximity to sidewall 107 and because shaped reflector 161 preferentially directs light emitted from LEDs 102A and 102B toward the sidewall 107.

More specifically, in some embodiments, reflective surfaces 162 and 163 of shaped reflector 161 direct more than fifty percent of the light output by LEDs 102A and 102B to sidewall 107. In some other embodiments, more than seventy five percent of the light output by LEDs 102A and 102B is directed to sidewall 107 by shaped reflector 161. In some other embodiments, more than ninety percent of the light output by LEDs 102A and 102B is directed to sidewall 107 by shaped reflector 161.

As illustrated, some LEDs 102C and 102D are located in zone 2. Light emitted from LEDs 102C and 102D in zone 2 is directed toward output window 108 by shaped reflector 161. More specifically, reflective surfaces 164 and 165 of shaped reflector 161 direct more than fifty percent of the light output by LEDs 102C and 102D to output window 108. In some other embodiments, more than seventy five percent of the light output by LEDs 102C and 102D is directed to output window 108 by shaped reflector 161. In some other embodiments, more than ninety percent of the light output by LEDs 102C and 102D is directed to output window 108 by shaped reflector 161.

In some embodiments, LEDs 102A and 102B in zone 1 may be selected with emission properties that interact efficiently with the wavelength converting material included in sidewall 107. For example, the emission spectrum of LEDs 102A and 102B in zone 1 and the wavelength converting material in sidewall 107 may be selected such that the emission spectrum of the LEDs and the absorption spectrum of the wavelength converting material are closely matched. This ensures highly efficient color conversion (e.g., conversion to red light). Similarly, LEDs 102C and 102D in zone 2 may be selected with emission properties that interact efficiently with the wavelength converting material included in output window 108. For example, the emission spectrum of LEDs 102C and 102D in zone 2 and the wavelength converting material in output window 108 may be selected such that the emission spectrum of the LEDs and the absorption spectrum of the wavelength converting material are closely matched. This ensures highly efficient color conversion (e.g., conversion to yellow light).

Furthermore, concentrating light emitted from some LEDs on surfaces with one wavelength converting material and other LEDs on surfaces with another wavelength converting material reduces the probability of absorption of color converted light by a different wavelength converting material. Thus, employing different zones of LEDs that each preferentially illuminates a different color converting surface minimizes the occurrence of an inefficient, two-step color conversion process. By way of example, a photon 138 generated by an LED (e.g., blue, violet, ultraviolet, etc.) from zone 2 is directed to color converting layer 135 by shaped reflector 161. Photon 138 interacts with a wavelength converting material in color converting layer 135 and is converted to a Lambertian emission of color converted light (e.g., yellow light). By minimizing the content of red-emitting phosphor in color converting layer 135, the probability is increased that the back reflected yellow light will be reflected once again toward the output window 108 without absorption by another wavelength converting material. Similarly, a photon 137 generated by an LED (e.g., blue, violet, ultraviolet, etc.) from zone 1 is directed to color converting layer 172 by shaped reflector 161. Photon 137 interacts with a wavelength converting material in color converting layer 172 and is converted to a Lambertian emission of color converted light (e.g., red light). By minimizing the content of yellow-emitting phosphor in color converting layer 172, the probability is increased that the back reflected red light will be reflected once again toward the output window 108 without reabsorption.

Figure 7:
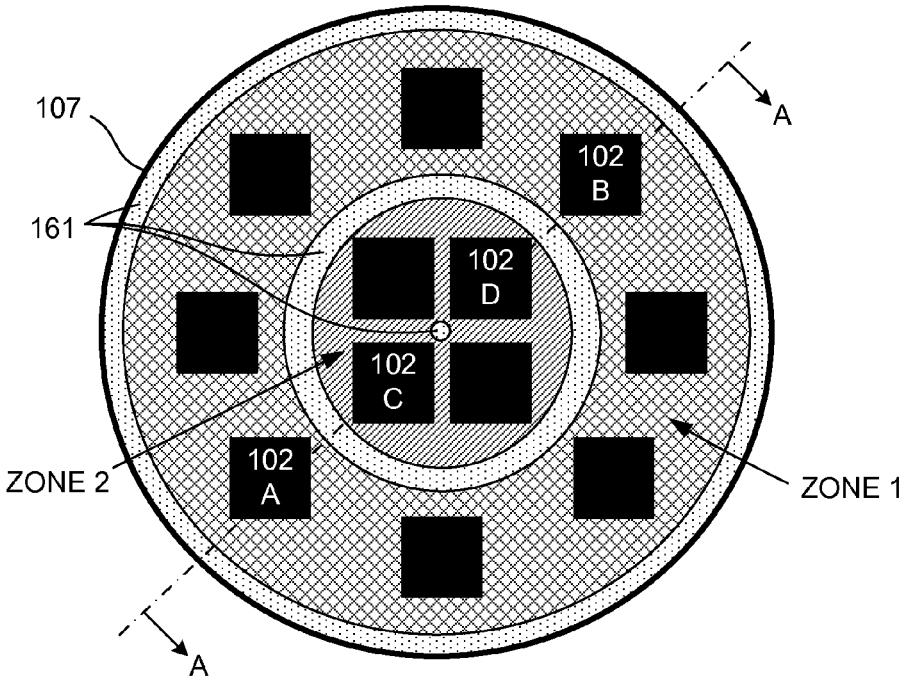
FIG. 7 is illustrative of a top view of the LED based illumination module depicted in FIG. 6.

FIG. 7 is illustrative of a top view of LED based illumination module 100 depicted in FIG. 6. Section A depicted in FIG. 7 is the cross-sectional view depicted in FIG. 6. As depicted, in this embodiment, LED based illumination module 100 is circular in shape as illustrated in the exemplary configurations depicted in FIG. 2 and FIG. 3. In this embodiment, LED based illumination module 100 is divided into annular zones (e.g., zone 1 and zone 2) that include different groups of LEDs 102. As illustrated, zones 1 and zones 2 are separated and defined by shaped reflector 161. Although, LED based illumination module 100, as depicted in FIGS. 6 and 7, is circular in shape. Other shapes may be contemplated. For example, LED based illumination module 100 may be polygonal in shape. In other embodiments, LED based illumination module 100 may be any other closed shape (e.g., elliptical, etc.). Similarly, other shapes may be contemplated for any zones of LED based illumination module 100.

Figure 20:
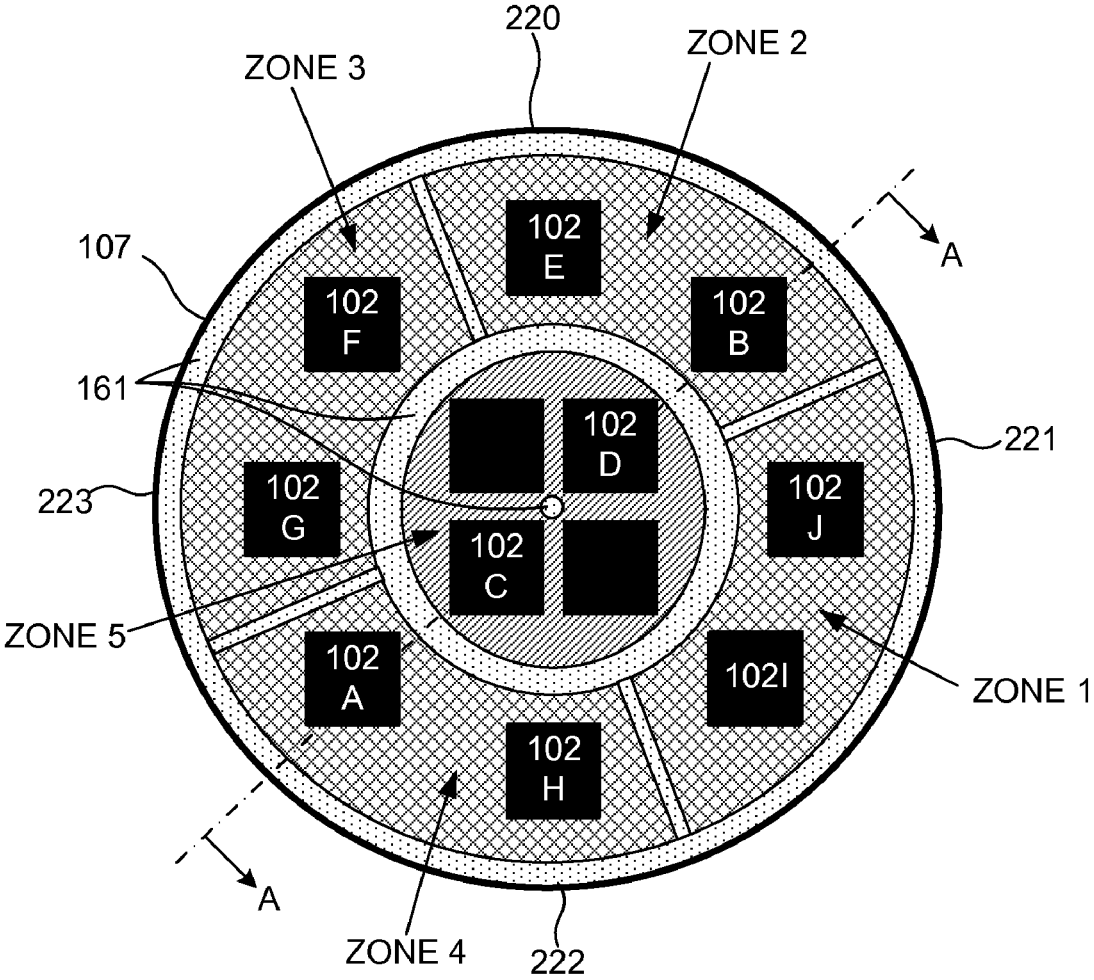
FIG. 20 is illustrative of a top view of an LED based illumination module that is divided into five zones.

As depicted in FIG. 7, LED based illumination module 100 is divided into two zones. However, more zones may be contemplated. For example, as depicted in FIG. 20, LED based illumination module 100 is divided into five zones. Zones 1-4 subdivide sidewall 107 into a number of distinct color converting surfaces. In this manner light emitted from LEDs 102I and 102J in zone 1 is preferentially directed to color converting surface 221 of sidewall 107, light emitted from LEDs 102B and 102E in zone 2 is preferentially directed to color converting surface 220 of sidewall 107, light emitted from LEDs 102F and 102G in zone 3 is preferentially directed to color converting surface 223 of sidewall 107, and light emitted from LEDs 102A and 102H in zone 4 is preferentially directed to color converting surface 222 of sidewall 107. The five zone configuration depicted in FIG. 20 is provided by way of example. However, many other numbers and combinations of zones may be contemplated.

In some embodiments, the locations of LEDs 102 within LED based illumination module 100 are selected to achieve uniform light emission properties of combined light 141. In some embodiments, the location of LEDs 102 may be symmetric about an axis in the mounting plane of LEDs 102 of LED based illumination module 100. In some embodiments, the location of LEDs 102 may be symmetric about an axis perpendicular to the mounting plane of LEDs 102. Shaped reflector 161 preferentially directs light emitted from some LEDs 102 toward an interior surface or a number of interior surfaces and preferentially directs light emitted from some other LEDs 102 toward another interior surface or number of interior surfaces of color conversion cavity 160. The location of shaped reflector 161 may be selected to promote efficient light extraction from color conversion cavity 160 and uniform light emission properties of combined light 141. In such embodiments, light emitted from LEDs 102 closest to sidewall 107 is preferentially directed toward sidewall 107. However, in some embodiments, light emitted from LEDs close to sidewall 107 may be directed toward output window 108 to avoid an excessive amount of color conversion due to interaction with sidewall 107. Conversely, in some other embodiments, light emitted from LEDs distant from sidewall 107 may be preferentially directed toward sidewall 107 when additional color conversion due to interaction with sidewall 107 is necessary.

Figure 8:
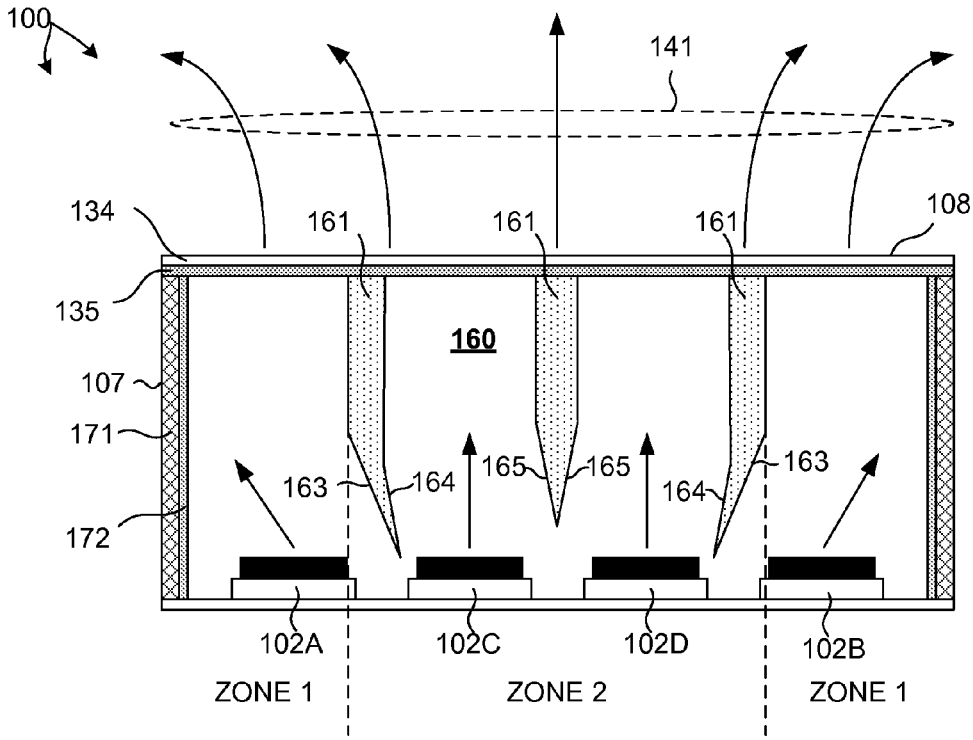
FIG. 8 is illustrative of a cross-section of the LED based illumination module similar to that depicted in FIGS. 6 and 7, with a shaped reflector attached to the output window.

FIG. 8 is illustrative of a cross-section of LED based illumination module 100 similar to that depicted in FIGS. 6 and 7 except that in the depicted embodiment, shaped reflector 161 is attached to output window 108. As depicted shaped reflector 161 includes reflective surfaces 163-165 to preferentially direct light emitted from LEDs 102A and 102B toward sidewall 107 and to preferentially direct light emitted from LEDs 102C and 102D toward output window 108. In some embodiments, shaped reflector 161 may be formed as part of output window 108. In some other embodiments, shaped reflector 161 may be formed separately from output window 108 and attached to output window 108 (e.g., by adhesive, welding, etc.). By including shaped reflector 161 as part of output window 108, both shaped reflector 161 and output window 108 may be treated as a single component for purposes of color tuning of LED based illumination module 100. This may be particularly beneficial if wavelength converting material is included as part of shaped reflector 161. By including shaped reflector 161 as part of output window 108, the amount of light mixing in color conversion cavity 160 may be controlled by altering the distance that shaped reflector 161 extends from output window 108 toward LEDs 102.

Figure 9:
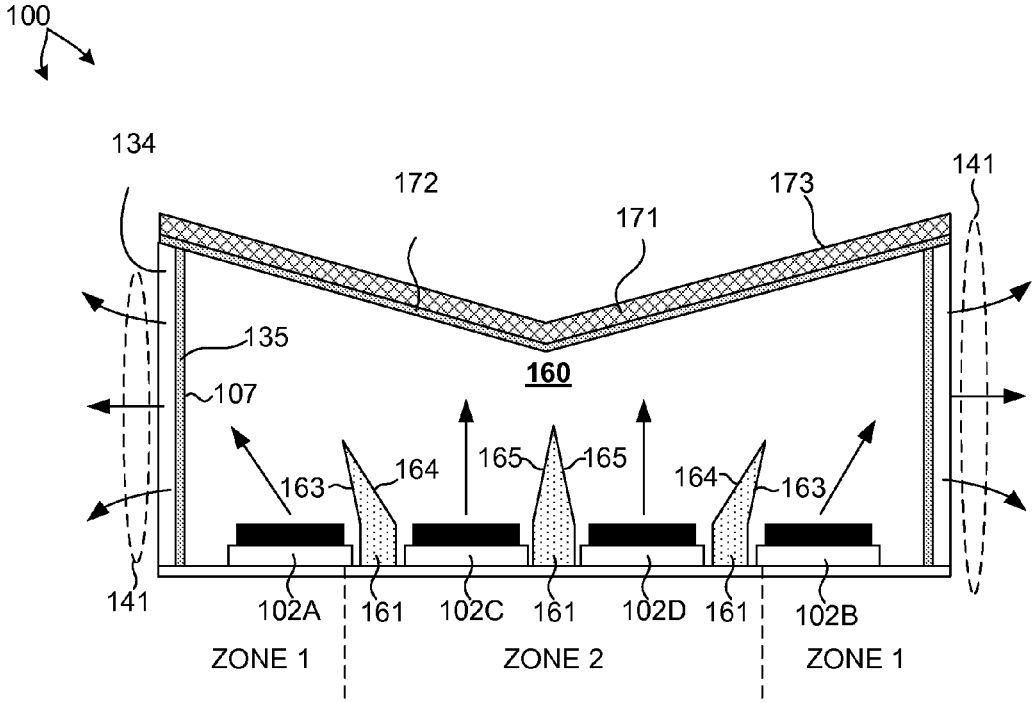
FIG. 9 illustrates an example of a side emitting LED based illumination module that includes a shaped reflector that includes reflective surfaces to preferentially direct light emitted from LEDs toward a sidewall or output window.

FIG. 9 illustrates an example of a side emitting LED based illumination module 100 that includes a shaped reflector 161 that includes reflective surfaces 163-165 to preferentially direct light emitted from LEDs 102A and 102B toward sidewall 107 and to preferentially direct light emitted from LEDs 102C and 102D toward output window 108. In side-emitting embodiments, collective light 141 is emitted from LED based illumination module 100 through transmissive sidewall 107. In some embodiments, top wall 173 is reflective and is shaped to direct light toward sidewall 107.

Figure 10:
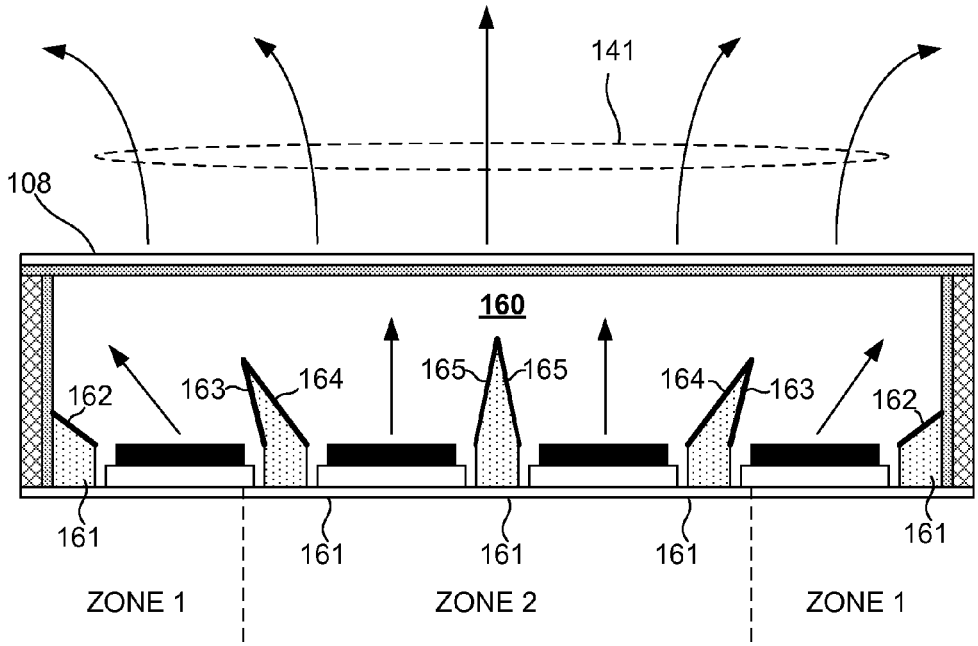
FIG. 10 is illustrative of a cross-section of a LED based illumination module similar to that depicted in FIGS. 6 and 7 with reflective surfaces of shaped reflector having at least one wavelength converting material.

FIG. 10 is illustrative of a cross-section of LED based illumination module 100 similar to that depicted in FIGS. 6 and 7 except that in the depicted embodiment, some or all of the reflective surfaces of shaped reflector 161 include at least one wavelength converting material. In the example depicted in FIG. 10, reflective surfaces 162-165, each include a layer of wavelength converting material. By including a wavelength converting material, the exposure of reflective surfaces 162-165 to light emitted from LEDs 102 may be exploited for purposes of color conversion in addition to preferentially directing light toward specific interior surfaces of color conversion cavity 160. By including at least one wavelength converting material on shaped reflector 161, the amount of color converted light output by LED based illumination module 100 may be increased along with uniformity of combined light 141. Any number of wavelength converting materials may be included with shaped reflector 161. In some embodiments wavelength converting material 161 may be included in a coating over shaped reflector 161. In some embodiments, the coating may be patterned (e.g., dots, stripes, etc.). In some other embodiments, wavelength converting material may be embedded in shaped reflector 161. For example, wavelength converting material may be included in the material from which shaped reflector 161 is formed.

Figure 11:
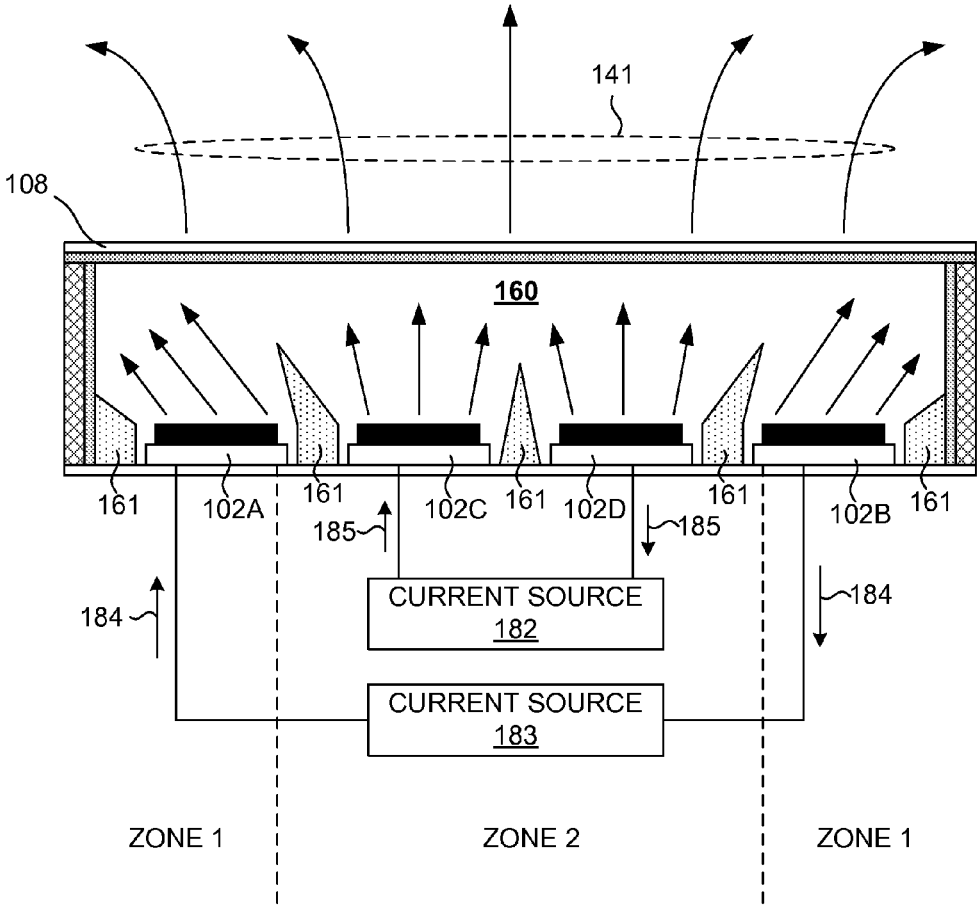
FIG. 11 is illustrative of a cross-section of a LED based illumination module similar to that depicted in FIGS. 6 and 7 with different current source supplying current to the LEDs in different preferential zones.

FIG. 11 is illustrative of a cross-section of LED based illumination module 100 similar to that depicted in FIGS. 6 and 7 except that in the depicted embodiment, a different current source supplies current to LEDs 102 in different preferential zones. In the example depicted in FIG. 11, current source 182 supplies current 185 to LEDs 102C and 102D located in preferential zone 2. Similarly, current source 183 supplies current 184 to LEDs 102A and 102B located in preferential zone 1. By separately controlling the current supplied to LEDs located in different preferential zones, color tuning may be achieved. For example, as discussed with respect to FIG. 6, light emitted from LEDs located in preferential zone 1 is directed to sidewall 107 that may include a red-emitting phosphor material, whereas light emitted from LEDs located in preferential zone 2 is directed to output window 108 that may include a yellow-emitting phosphor material. By adjusting the current 184 supplied to LEDs located in zone 1 relative to the current 185 supplied to LEDs located in zone 2, the amount of red light relative to yellow light included in combined light 141 may be adjusted. In this manner, control of currents 184 and 185 may be used to tune the color of light emitted from LED based illumination module 100.

Figure 12:
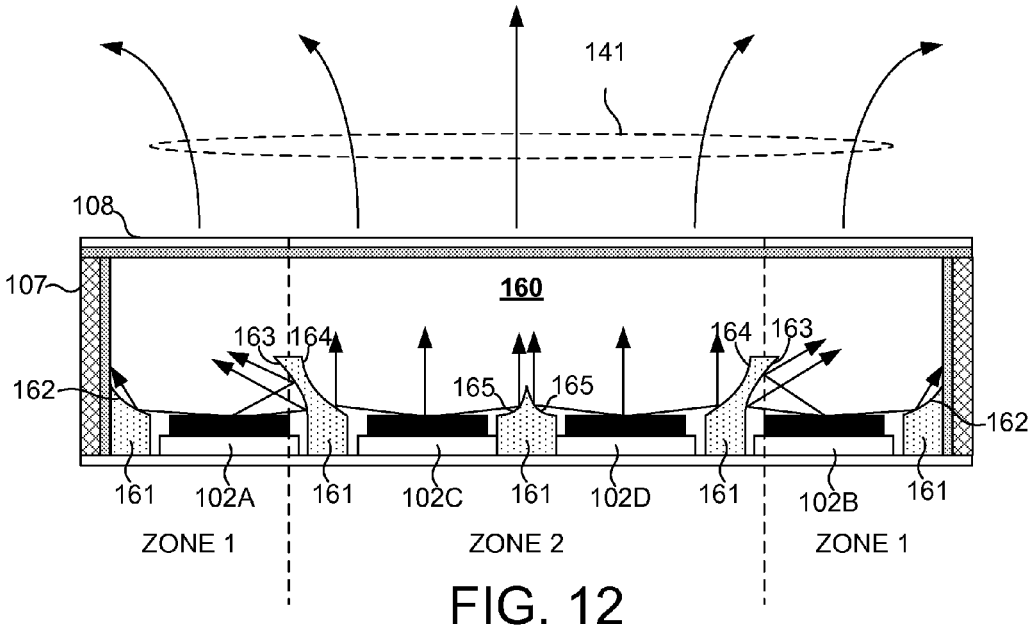
FIG. 12 is illustrative of a cross-section of a LED based illumination module similar to that depicted in FIGS. 6 and 7.

FIG. 12 is illustrative of a cross-section of LED based illumination module 100 similar to that depicted in FIGS. 6 and 7. In the depicted embodiment, portions of shaped reflector 161 include a parabolic surface shape that directs light to specific interior surfaces of color conversion cavity 160. As depicted in FIG. 12, each of reflective surfaces 163-165 includes a parabolic shaped profile. For example, each of reflective surfaces 164 and 165 includes a parabolic shaped profile that preferentially directs light emitted from LEDs 102C and 102D toward output window 108, and reflective surface 163 includes a parabolic shaped profile that preferentially directs light emitted from LEDs 102A and 102B toward sidewall 107. By employing a parabolic shaped profile, reflective surface 163 preferentially directs light toward sidewall 107 in approximately parallel paths. In this manner, sidewall 107 is flooded with light emitted from LEDs 102A and 102B as uniformly as possible. By uniformly flooding sidewall 107 with light, hot spots and saturation of any wavelength converting material on sidewall 107 are avoided. Similarly, reflective surfaces 164 and 165 with a parabolic shaped profile preferentially direct light toward output window 108 in approximately parallel paths. In this manner, output window 108 is flooded with light emitted from LEDs 102C and 102D as uniformly as possible. By uniformly flooding output window 108 with light, hot spots and saturation of any wavelength converting material on output window 108 are avoided. Furthermore, output beam uniformity of combined light 141 is improved.

Figure 13:
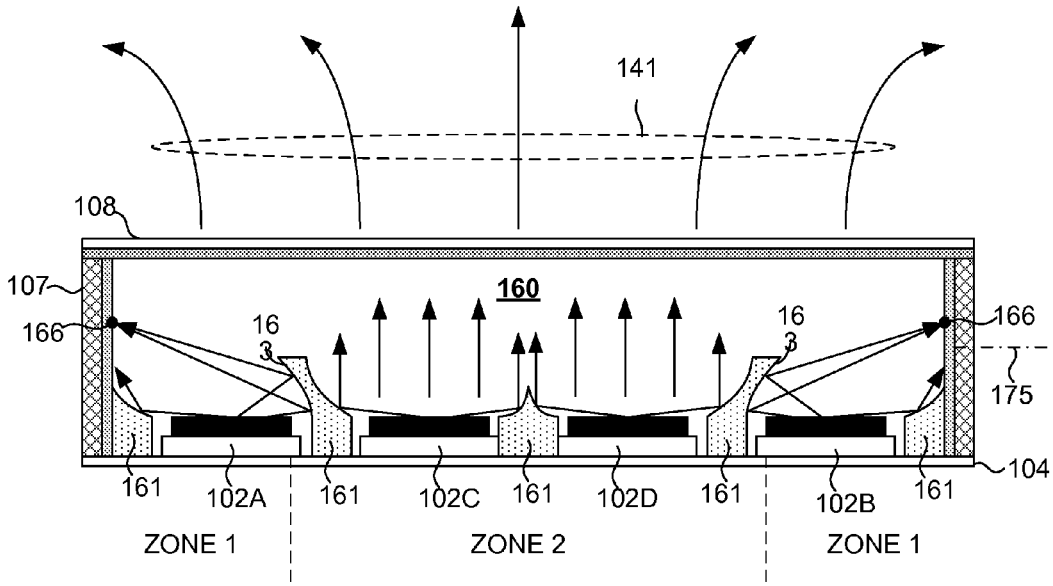
FIG. 13 is illustrative of a cross-section of a LED based illumination module similar to that depicted in FIGS. 6 and 7.

FIG. 13 is illustrative of a cross-section of LED based illumination module 100 similar to that depicted in FIGS. 6 and 7. In the depicted embodiment, portions of shaped reflector 161 include an elliptically shaped surface profile that directs light to specific interior surfaces of color conversion cavity 160. As depicted in FIG. 13, reflective surface 163 includes an elliptically shaped profile that preferentially directs light emitted from LEDs 102A and 102B toward sidewall 107. By employing an elliptically shaped profile, reflective surface 163 preferentially directs light toward sidewall 107 approximately at a focused line (depicted as a point 166 in the cross-sectional representation of FIG. 13). In this manner, light emitted from LEDs 102A and 102B is focused to a small area where color conversion can occur with a reduced probability of reabsorption. In some embodiments, the line of focus of light preferentially directed toward sidewall 107 by shaped reflector 161 is located above the midpoint of the distance extending from the mounting board 104 to which LEDs 102 are attached and output window 108. As depicted in FIG. 13, datum 175 marks the midpoint of the distance extending from the mounting board 104 and output window 108. The line of focus of elliptically shaped surface 163 lies closer to output window 108 than the mounting board 104 (i.e., above the datum 175). By locating the line of focus of elliptically shaped surface 163 above datum 175, improved light extraction efficiency may be achieved.

Figure 14:
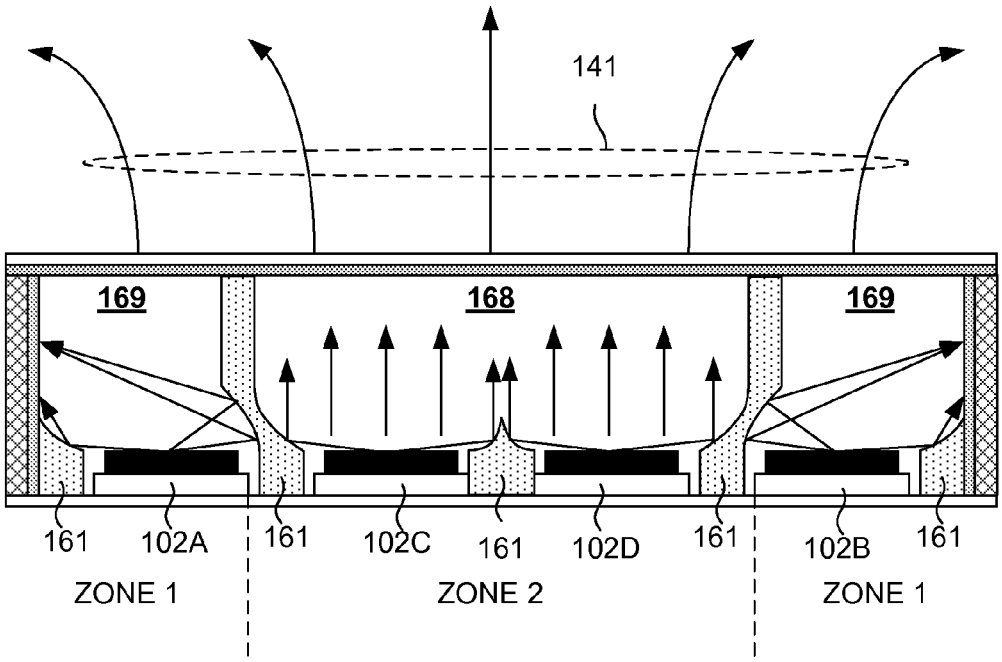
FIG. 14 is illustrative of a cross-section of a LED based illumination module similar to that depicted in FIGS. 6 and 7.

FIG. 14 is illustrative of a cross-section of LED based illumination module 100 similar to that depicted in FIGS. 6 and 7. In the depicted embodiment, portions of shaped reflector 161 extend from a plane upon which the LEDs 102 are mounted and output window 108. In this manner, shaped reflector 161 partitions the color conversion cavity of LED based illumination module 100 into multiple color conversion cavities. As illustrated in FIG. 14, LED based illumination module 100 includes color conversion cavity 168 and color conversion cavity 169. Light emitted from LEDs 102A and 102B located in preferential zone 1 is directed into color conversion cavity 169. Light emitted from LEDs 102C and 102D located in preferential zone 2 is directed into color conversion cavity 168. By subdividing LED based illumination module 100 into multiple color conversion cavities with shaped reflector 161, light emitted from some LEDs (e.g., LEDs 102C and 102D) may be optically isolated from some interior surfaces of LED based illumination module 100 (e.g., sidewall 107). In this manner greater color conversion efficiency may be achieved by minimizing reabsorption losses.

Figure 15:
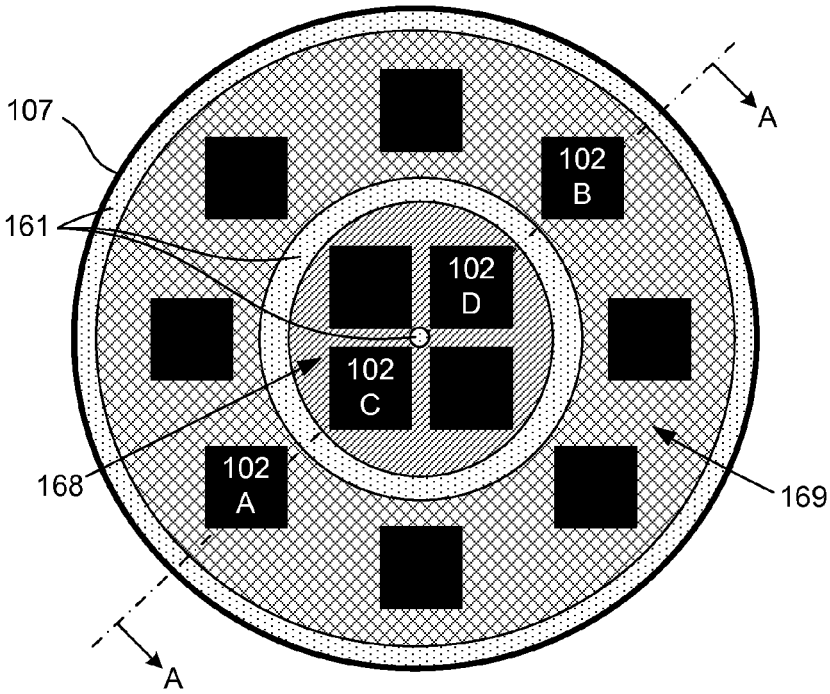
FIG. 15 is illustrative of a top view of the LED based illumination module depicted in FIG. 14.

FIG. 15 is illustrative of a top view of LED based illumination module 100 depicted in FIG. 14. Section A depicted in FIG. 15 is the cross-sectional view depicted in FIG. 14. As depicted, in this embodiment, LED based illumination module 100 is circular in shape as illustrated in the exemplary configurations depicted in FIG. 2 and FIG. 3. In this embodiment, LED based illumination module 100 is divided into color conversion cavities 168 and 169 that are separated and defined by shaped reflector 161. Although, LED based illumination module 100 depicted in FIGS. 14 and 15 is circular in shape, other shapes may be contemplated. For example, LED based illumination module 100 may be polygonal in shape. In other embodiments, LED based illumination module 100 may be any other closed shape (e.g., elliptical, etc.). In some embodiments, LEDs 102 may be located within LED based illumination module 100 to achieve uniform light emission properties of combined light 141. In some embodiments, the location of LEDs 102 may be symmetric about an axis in the mounting plane of LEDs 102 of LED based illumination module 100. In some embodiments, the location of LEDs 102 may be symmetric about an axis perpendicular to the mounting plane of LEDs 102. Shaped reflector 161 preferentially directs light emitted from LEDs 102A and 102B toward an interior surface or a number of interior surfaces of color conversion cavity 169, and preferentially directs light emitted from LEDs 102C and 102D toward an interior surface or a number of interior surfaces of color conversion cavity 168. The location of shaped reflector 161 may be selected to promote efficient light extraction from color conversion cavity 160 and uniform light emission properties of combined light 141.

Figure 16:
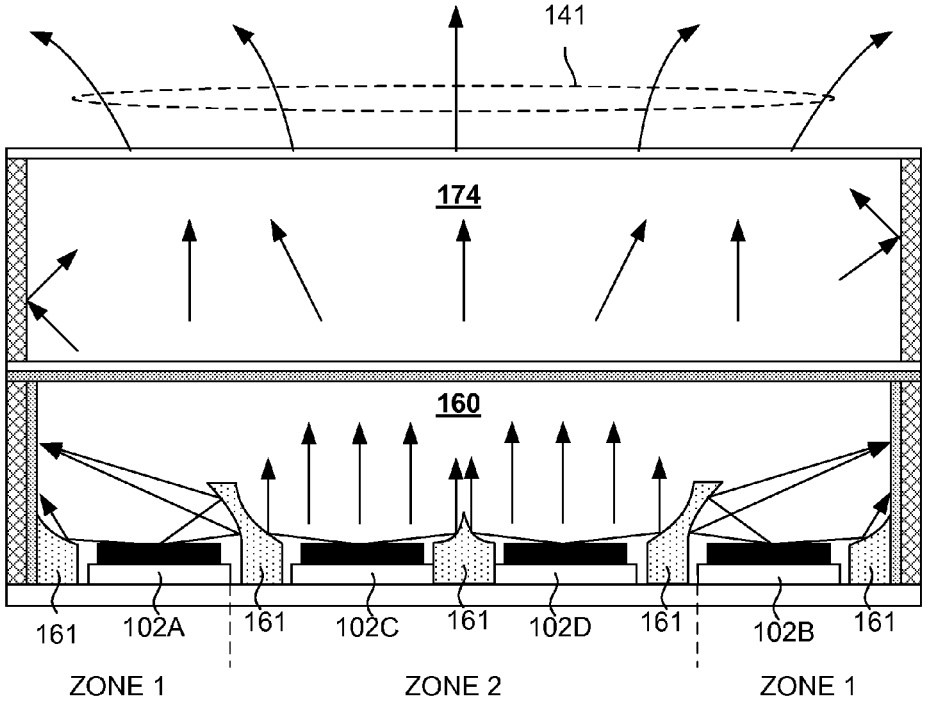
FIG. 16 is illustrative of a cross-section of a LED based illumination module similar to that depicted in FIGS. 6 and 7.

FIG. 16 is illustrative of a cross-section of LED based illumination module 100 similar to that depicted in FIGS. 6 and 7. In the depicted embodiment, a secondary light mixing cavity 174 receives the light emitted from color conversion cavity 160 and emits combined light 141 emitted from LED based illumination module 100. Secondary light mixing cavity 174 includes reflective interior surfaces that promote light mixing. In this manner, light emitted from color conversion cavity 160 is further mixed in secondary light mixing cavity 174 before exiting LED based illumination module 100. The resulting combined light 141 emitted from LED based illumination module 100 is highly uniform in color and intensity. In some embodiments (not shown), secondary light mixing cavity 174 may include wavelength converting materials located on interior surfaces of cavity 174 to perform color conversion in addition to light mixing. Secondary light mixing cavity 174 may be included as part of LED based illumination module 100 in any of the embodiments discussed in this patent document.

Figure 17:
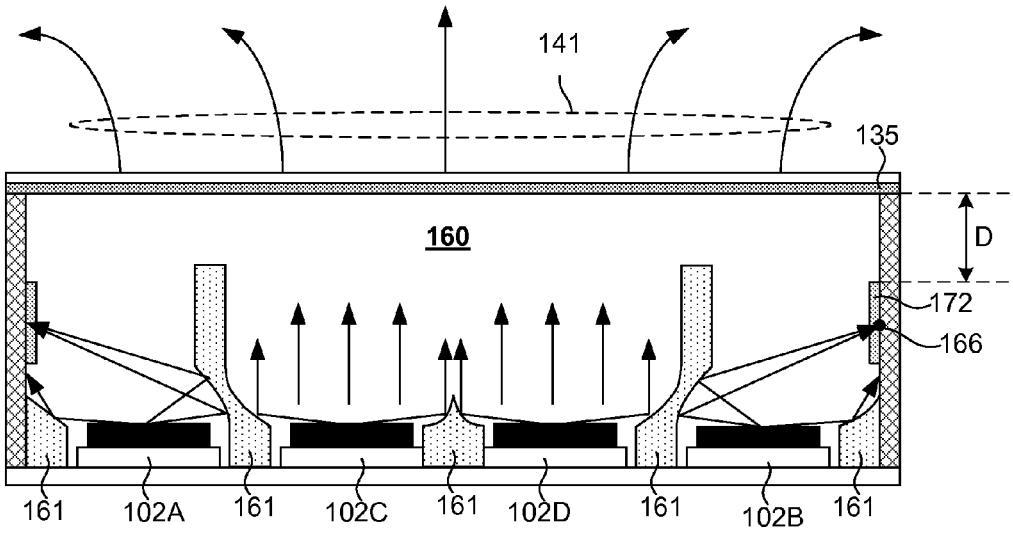
FIG. 17 is illustrative of a cross-section of a LED based illumination module similar to that depicted in FIGS. 6 and 7.

FIG. 17 is illustrative of a cross-section of LED based illumination module 100 similar to that depicted in FIGS. 6 and 7. In the depicted embodiment, color converting layer 172 covers a limited portion of sidewall 107. In the depicted embodiment, color converting layer 172 is an annular ring shape covering a portion of the interior surface of sidewall 107. As depicted, color converting layer 172 does not extend to the output window 108. By not extending to the output window, a distance, D, is maintained between the different wavelength converting materials included in color converting layer 135 of output window 108 and color converting layer 172 of sidewall 107. This reduces the probability of reabsorption by differing wavelength converting materials, thus increasing extraction efficiency of color converting cavity 160. In some embodiments (not shown), color converting layer 172 extends to meet shaped reflector 161. In some other embodiments (as depicted in FIG. 17), color converting layer 172 does not extend all the way to shaped reflector 161. In this manner, the dimension of color converting layer 172 may be selected to achieve the desired amount of color conversion.

In many application environments, it is desirable to significantly vary the color temperature and intensity of light emitted from the installed light source. For example, in a restaurant environment during lunchtime, it is desirable to have bright lighting with a relatively high color temperature (e.g., 3,000K). However, in the same restaurant at dinnertime, it is desirable to reduce both the intensity and the color temperature of the emitted light. In an evening dining setting, it may be desirable to generate light with a CCT less than 2100K. For example, sunrise/sunset light levels exhibit a CCT of approximately 2000K. In another example, a candle flame exhibits a CCT of approximately 1900K. Restaurants that desire to emulate these light levels may dim incandescent light sources, filter their emission to achieve these CCT levels, or add additional light sources (e.g., light a candle at each table). A halogen light source commonly used in restaurant environments emits light with a color temperature of approximately 3,000K at full operating power. Due to the nature of a halogen lamp, a reduction in emission intensity also reduces the CCT of the light emitted from the halogen light source. Thus, halogen lamps may be dimmed to reduce the CCT of the emitted light. However, the relationship between CCT and luminous intensity for a halogen lamp is fixed for a particular device, and may not be desirable in many operational environments.

Figure 18:
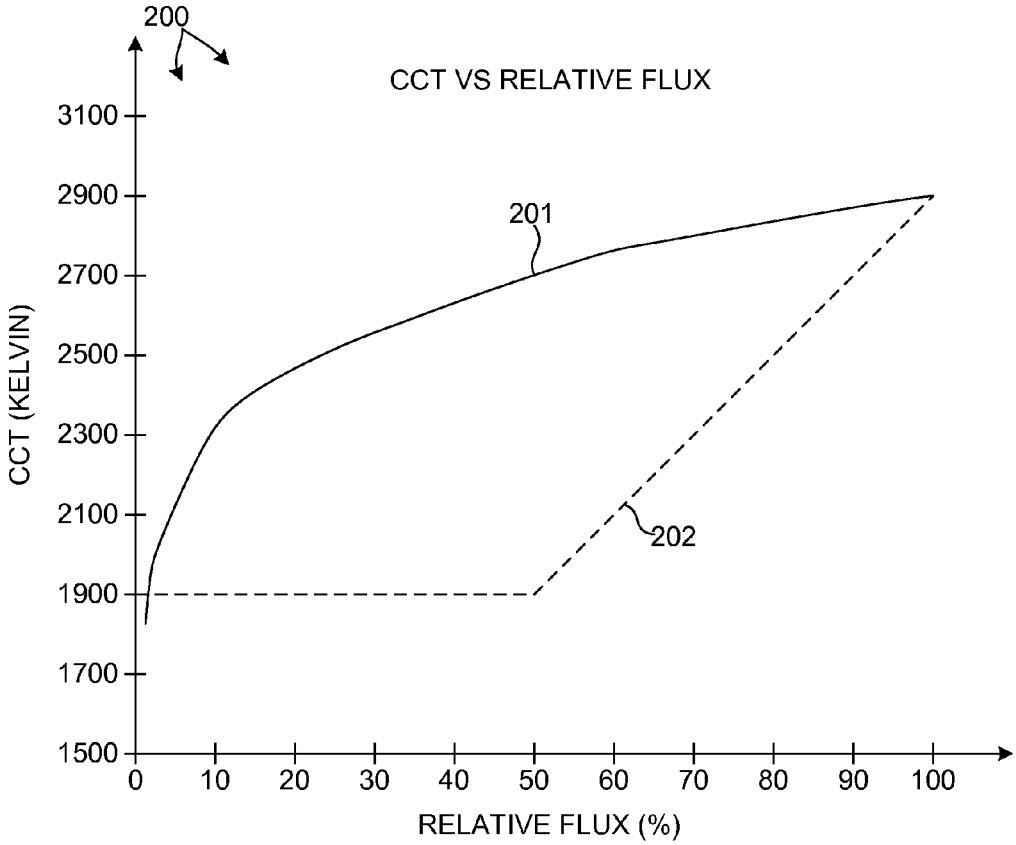
FIG. 18 illustrates a plot of correlated color temperature (CCT) versus relative flux for a halogen light source.

FIG. 18 illustrates a plot 200 of correlated color temperature (CCT) versus relative flux for a halogen light source. Relative flux is plotted as a percentage of the maximum rated power level of the device. For example, 100% is operation of the light source at it maximum rated power level, and 50% is operation of the light source at half its maximum rated power level. Plotline 201 is based on experimental data collected from a 35W halogen lamp. As illustrated, at the maximum rated power level, the 35W halogen lamp light emission was 2900K. As the halogen lamp is dimmed to lower relative flux levels, the CCT of light output from the halogen lamp is reduced. For example, at 25% relative flux, the CCT of the light emitted from the halogen lamp is approximately 2500K. To achieve further reductions in CCT, the halogen lamp must be dimmed to very low relative flux levels. For example, to achieve a CCT less than 2100K, the halogen lamp must be driven to a relative flux level of less than 5%. Although, a traditional halogen lamp is capable of achieving CCT levels below 2100K, it is able to do so only by severely reducing the intensity of light emitted from each lamp. These extremely low intensity levels leave dining spaces very dark and uncomfortable for patrons. A more desirable option is a light source that exhibits dimming characteristics illustrated by line 202. Line 202 exhibits a reduction in CCT as light intensity is reduced to from 100% to 50% relative flux. At 50% relative flux, a CCT of 1900K is obtained. Further reductions, in relative flux do not change the CCT significantly. In this manner, a restaurant operator may adjust the intensity of the light level in the environment over a broad range to a desired level without changing the desirable CCT characteristics of the emitted light. Line 202 is illustrated by way of example. Many other desirable color characteristics for dimmable light sources may be contemplated.

In some embodiments, LED based illumination module 100 may be configured to achieve relatively large changes in CCT with relatively small changes in flux levels (e.g., as illustrated in line 202 from 50-100% relative flux) and also achieve relatively large changes in flux level with relatively small changes in CCT (e.g., as illustrated in line 202 from 0-50% relative flux).

Figure 19:
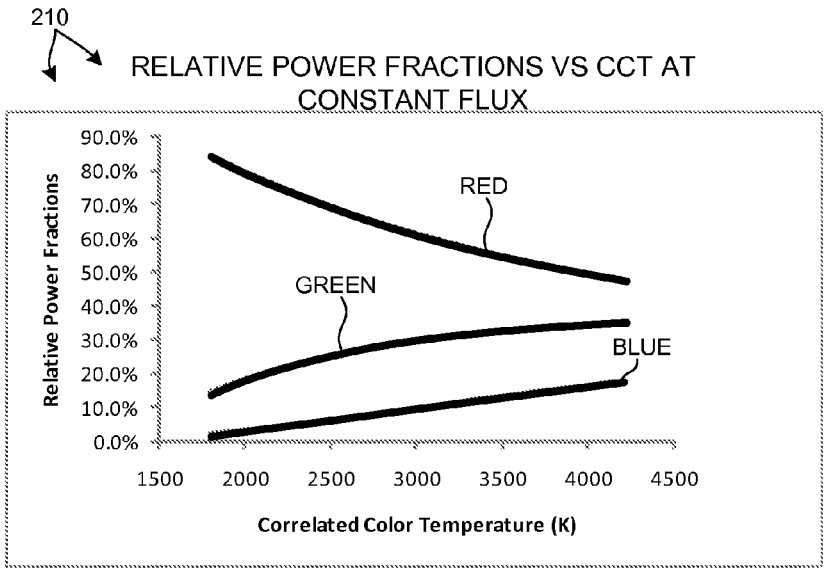
FIG. 19 illustrates a plot of simulated relative power fractions necessary to achieve a range of CCTs for light emitted from an LED based illumination module.

FIG. 19 illustrates a plot 210 of simulated relative power fractions necessary to achieve a range of CCTs for light emitted from an LED based illumination module 100. The relative power fractions describe the relative contribution of three different light emitting elements within LED based illumination module 100: an array of blue emitting LEDs, an amount of green emitting phosphor (model BG201A manufactured by Mitsubishi, Japan), and an amount of red emitting phosphor (model BR102D manufactured by Mitsubishi, Japan). As illustrated in FIG. 19, to achieve a CCT level below 2100K, contributions from a red emitting element must dominate over both green and blue emission. In addition, blue emission must be significantly attenuated.

Small changes in CCT over the full operational range of an LED based illumination module 100 may be achieved by employing LEDs with similar emission characteristics (e.g., all blue emitting LEDs) that preferentially illuminate different color converting surfaces. By controlling the relative flux emitted from different zones of LEDs (by independently controlling current supplied to LEDs in different zones as illustrated in FIG. 11), small changes in CCT may be achieved. For example, changes of more than 300K over the full operational range may be achieved in this manner.

Large changes in CCT over the operational range of an LED based illumination module 100 may be achieved by introducing different LEDs that preferentially illuminate different color converting surfaces. By controlling the relative flux emitted from different zones of LEDs of different types (by independently controlling current supplied to LEDs in different zones as illustrated in FIG. 11), large changes in CCT may be achieved. For example, changes of more than 500K may be achieved in this manner.

In one embodiment, LEDs 102 positioned in zone 2 of FIG. 7 are ultraviolet emitting LEDs, while LEDs 102 positioned in zone 1 of FIG. 7 are blue emitting LEDs. Color converting layer 172 includes any of a yellow-emitting phosphor and a green-emitting phosphor. Color converting layer 135 includes a red-emitting phosphor. The yellow and/or green emitting phosphors included in sidewall 107 are selected to have narrowband absorption spectra centered near the emission spectrum of the blue LEDs of zone 1, but far away from the emission spectrum of the ultraviolet LEDs of zone 2. In this manner, light emitted from LEDs in zone 2 is preferentially directed to output window 108, and undergoes conversion to red light. In addition, any amount of light emitted from the ultraviolet LEDs that illuminates sidewall 107 results in very little color conversion because of the insensitivity of these phosphors to ultraviolet light. In this manner, the contribution of light emitted from LEDs in zone 2 to combined light 141 is almost entirely red light. In this manner, the amount of red light contribution to combined light 141 can be influenced by current supplied to LEDs in zone 2. Light emitted from blue LEDs positioned in zone 1 is preferentially directed to sidewall 107 and results in conversion to green and/or yellow light. In this manner, the contribution of light emitted from LEDs in zone 1 to combined light 141 is a combination of blue and yellow and/or green light. Thus, the amount of blue and yellow and/or green light contribution to combined light 141 can be influenced by current supplied to LEDs in zone 1.

To emulate the desired dimming characteristics illustrated by line 202 of FIG. 18, LEDs in zones 1 and 2 may be independently controlled. For example, at 2900K, the LEDs in zone 1 may operate at maximum current levels with no current supplied to LEDs in zone 2. To reduce the color temperature, the current supplied to LEDs in zone 1 may be reduced while the current supplied to LEDs in zone 2 may be increased. Since the number of LEDs in zone 2 is less than the number in zone 1, the total relative flux of LED based illumination module 100 is reduced. Because LEDs in zone 2 contribute red light to combined light 141, the relative contribution of red light to combined light 141 increases. As indicated in FIG. 19, this is necessary to achieve the desired reduction in CCT. At 1900K, the current supplied to LEDs in zone 1 is reduced to a very low level or zero and the dominant contribution to combined light comes from LEDs in zone 2. To further reduce the output flux of LED based illumination module 100, the current supplied to LEDs in zone 2 is reduced with little or no change to the current supplied to LEDs in zone 1. In this operating region, combined light 141 is dominated by light supplied by LEDs in zone 2. For this reason, as the current supplied to LEDs in zone 2 is reduced, the color temperature remains roughly constant (1900K in this example).

As discussed with respect to FIG. 20, additional zones may be employed. For example, color converting surfaces zones 221 and 223 in zones 1 and 3, respectively may include a densely packed yellow and/or green emitting phosphor, while color converting surfaces 220 and 222 in zones 2 and 4, respectively, may include a sparsely packed yellow and/or green emitting phosphor. In this manner, blue light emitted from LEDs in zones 1 and 3 may be almost completely converted to yellow and/or green light, while blue light emitted from LEDs in zones 2 and 4 may only be partially converted to yellow and/or green light. In this manner, the amount of blue light contribution to combined light 141 may be controlled by independently controlling the current supplied to LEDs in zones 1 and 3 and to LEDs in zones 2 and 4. More specifically, if a relatively large contribution of blue light to combined light 141 is desired, a large current may be supplied to LEDs in zones 2 and 4, while a current supplied to LEDs in zones 1 and 3 is minimized. However, if relatively small contribution of blue light is desired, only a limited current may be supplied to LEDs in zones 2 and 4, while a large current is supplied to LEDs in zones 1 and 3. In this manner, the relative contributions of blue light and yellow and/or green light to combined light 141 may be independently controlled. This may be useful to tune the light output generated by LED based illumination module 100 to match a desired dimming characteristic (e.g., line 202). The aforementioned embodiment is provided by way of example. Many other combinations of different zones of independently controlled LEDs preferentially illuminating different color converting surfaces may be contemplated to a desired dimming characteristic.

In some embodiments, components of color conversion cavity 160 including shaped reflector 161 may be constructed from or include a PTFE material. In some examples the component may include a PTFE layer backed by a reflective layer such as a polished metallic layer. The PTFE material may be formed from sintered PTFE particles. In some embodiments, portions of any of the interior facing surfaces of color converting cavity 160 may be constructed from a PTFE material. In some embodiments, the PTFE material may be coated with a wavelength converting material. In other embodiments, a wavelength converting material may be mixed with the PTFE material.

In other embodiments, components of color conversion cavity 160 may be constructed from or include a reflective, ceramic material, such as ceramic material produced by CerFlex International (The Netherlands). In some embodiments, portions of any of the interior facing surfaces of color converting cavity 160 may be constructed from a ceramic material. In some embodiments, the ceramic material may be coated with a wavelength converting material.

In other embodiments, components of color conversion cavity 160 may be constructed from or include a reflective, metallic material, such as aluminum or Miro® produced by Alanod (Germany). In some embodiments, portions of any of the interior facing surfaces of color converting cavity 160 may be constructed from a reflective, metallic material. In some embodiments, the reflective, metallic material may be coated with a wavelength converting material.

In other embodiments, (components of color conversion cavity 160 may be constructed from or include a reflective, plastic material, such as Vikuiti™ ESR, as sold by 3M (USA), Lumirror™ E60L manufactured by Toray (Japan), or microcrystalline polyethylene terephthalate (MCPET) such as that manufactured by Furukawa Electric Co. Ltd. (Japan). In some embodiments, portions of any of the interior facing surfaces of color converting cavity 160 may be constructed from a reflective, plastic material. In some embodiments, the reflective, plastic material may be coated with a wavelength converting material.

Cavity 160 may be filled with a non-solid material, such as air or an inert gas, so that the LEDs 102 emits light into the non-solid material. By way of example, the cavity may be hermetically sealed and Argon gas used to fill the cavity. Alternatively, Nitrogen may be used. In other embodiments, cavity 160 may be filled with a solid encapsulate material. By way of example, silicone may be used to fill the cavity. In some other embodiments, color converting cavity 160 may be filled with a fluid to promote heat extraction from LEDs 102. In some embodiments, wavelength converting material may be included in the fluid to achieve color conversion throughout the volume of color converting cavity 160.

The PTFE material is less reflective than other materials that may be used to construct or include in components of color conversion cavity 160 such as Miro® produced by Alanod. In one example, the blue light output of an LED based illumination module 100 constructed with uncoated Miro® sidewall insert 107 was compared to the same module constructed with an uncoated PTFE sidewall insert 107 constructed from sintered PTFE material manufactured by Berghof (Germany). Blue light output from module 100 was decreased 7% by use of a PTFE sidewall insert. Similarly, blue light output from module 100 was decreased 5% compared to uncoated Miro® sidewall insert 107 by use of an uncoated PTFE sidewall insert 107 constructed from sintered PTFE material manufactured by W.L. Gore (USA). Light extraction from the module 100 is directly related to the reflectivity inside the cavity 160, and thus, the inferior reflectivity of the PTFE material, compared to other available reflective materials, would lead away from using the PTFE material in the cavity 160. Nevertheless, the inventors have determined that when the PTFE material is coated with phosphor, the PTFE material unexpectedly produces an increase in luminous output compared to other more reflective materials, such as Miro®, with a similar phosphor coating. In another example, the white light output of an illumination module 100 targeting a correlated color temperature (CCT) of 4,000 Kelvin constructed with phosphor coated Miro® sidewall insert 107 was compared to the same module constructed with a phosphor coated PTFE sidewall insert 107 constructed from sintered PTFE material manufactured by Berghof (Germany). White light output from module 100 was increased 7% by use of a phosphor coated PTFE sidewall insert compared to phosphor coated Miro®. Similarly, white light output from module 100 was increased 14% compared to phosphor coated Miro® sidewall insert 107 by use of a PTFE sidewall insert 107 constructed from sintered PTFE material manufactured by W.L. Gore (USA). In another example, the white light output of an illumination module 100 targeting a correlated color temperature (CCT) of 3,000 Kelvin constructed with phosphor coated Miro® sidewall insert 107 was compared to the same module constructed with a phosphor coated PTFE sidewall insert 107 constructed from sintered PTFE material manufactured by Berghof (Germany). White light output from module 100 was increased 10% by use of a phosphor coated PTFE sidewall insert compared to phosphor coated Miro®. Similarly, white light output from module 100 was increased 12% compared to phosphor coated Miro® sidewall insert 107 by use of a PTFE sidewall insert 107 constructed from sintered PTFE material manufactured by W.L. Gore (USA).

Thus, it has been discovered that, despite being less reflective, it is desirable to construct phosphor covered portions of the light mixing cavity 160 from a PTFE material. Moreover, the inventors have also discovered that phosphor coated PTFE material has greater durability when exposed to the heat from LEDs, e.g., in a light mixing cavity 160, compared to other more reflective materials, such as Miro®, with a similar phosphor coating.

Although certain specific embodiments are described above for instructional purposes, the teachings of this patent document have general applicability and are not limited to the specific embodiments described above. For example, any component of color conversion cavity 160 may be patterned with phosphor. Both the pattern itself and the phosphor composition may vary. In one embodiment, the illumination device may include different types of phosphors that are located at different areas of a light mixing cavity 160. For example, a red phosphor may be located on either or both of the sidewall insert 107 and the bottom reflector insert 106 and yellow and green phosphors may be located on the top or bottom surfaces of the output window 108 or embedded within the output window 108. In one embodiment, different types of phosphors, e.g., red and green, may be located on different areas on the sidewalls 107. For example, one type of phosphor may be patterned on the sidewall insert 107 at a first area, e.g., in stripes, spots, or other patterns, while another type of phosphor is located on a different second area of the sidewall insert 107. If desired, additional phosphors may be used and located in different areas in the cavity 160. Additionally, if desired, only a single type of wavelength converting material may be used and patterned in the cavity 160, e.g., on the sidewalls. In another example, cavity body 105 is used to clamp mounting board 104 directly to mounting base 101 without the use of mounting board retaining ring 103. In other examples mounting base 101 and heat sink 120 may be a single component. In another example, LED based illumination module 100 is depicted in FIGS. 1-3 as a part of a luminaire 150. As illustrated in FIG. 3, LED based illumination module 100 may be a part of a replacement lamp or retrofit lamp. But, in another embodiment, LED based illumination module 100 may be shaped as a replacement lamp or retrofit lamp and be considered as such. Accordingly, various modifications, adaptations, and combinations of various features of the described embodiments can be practiced without departing from the scope of the invention as set forth in the claims.

What is claimed is:

1. An LED based illumination device, comprising:

a color conversion cavity comprising a first interior surface and a second interior surface;

a first LED mounted to a mounting board, wherein light emitted from the first LED enters the color conversion cavity;

a second LED mounted to the mounting board, wherein light emitted from the second LED enters the color conversion cavity; and a shaped reflector disposed above the mounting board, the shaped reflector including a first plurality of reflective surfaces that direct light emitted from the first LED to the first interior surface and a second plurality of reflective surfaces that direct light emitted from the second LED to the second interior surface.

2. The LED based illumination device of claim 1, wherein more than fifty percent of light emitted from the first LED is directed to the first interior surface.

3. The LED based illumination device of claim 2, wherein the first interior surface is a reflective sidewall and the second interior surface is a transmissive output window, the reflective sidewall including a height dimension extending from the mounting board to the transmissive output window, and wherein more than fifty percent of light emitted from the first LED is directed to a portion of the reflective sidewall within a distance of less than half the height dimension from the transmissive output window.

4. The LED based illumination device of claim 1, wherein the first interior surface includes a first wavelength converting material, and wherein the second interior surface includes a second wavelength converting material.

5. The LED based illumination device of claim 4, wherein a first current is supplied to the first LED, and wherein a second current is supplied to the second LED, and wherein the first current and the second current are selectable to achieve a target color point of light output by the LED based illumination device.

6. The LED based illumination device of claim 1, wherein the first interior surface is a transmissive sidewall, and wherein light output by the LED based illumination device exits the transmissive sidewall.

7. The LED based illumination device of claim 1, wherein the shaped reflector includes a parabolic shaped surface profile.

8. The LED based illumination device of claim 1, wherein the shaped reflector includes an elliptically shaped surface profile.

9. The LED based illumination device of claim 8, wherein a focal point of the elliptically shaped surface profile is approximately located on a surface of the first interior surface at a location that is closer to the second interior surface than to the first LED.

10. The LED based illumination device of claim 1, wherein the first LED is located closer to the first interior surface than the second LED.

11. The LED based illumination device of claim 1, wherein the shaped reflector includes a wavelength converting material.

12. An LED based illumination device, comprising:

a first color conversion cavity (CCC) comprising a first interior surface and a second interior surface;

a second CCC comprising a third interior surface and the second interior surface;

a first LED mounted to a mounting board, wherein light emitted from the first LED enters the first CCC;

a second LED mounted to the mounting board, wherein light emitted from the second LED enters the second CCC; and a shaped reflector disposed above the mounting board, the shaped reflector including a first plurality of reflective surfaces that direct light emitted from the first LED to the first interior surface and a second plurality of reflective surfaces that direct light emitted from the second LED to the third interior surface.

13. The LED based illumination device of claim 12, wherein more than fifty percent of light emitted from the first LED is directed to the first interior surface.

14. The LED based illumination device of claim 13, wherein the first interior surface is a reflective sidewall and the second interior surface is a transmissive output window, the reflective sidewall including a height dimension extending from the mounting board to the transmissive output window, and wherein more than fifty percent of light emitted from the first LED is directed to a portion of the reflective sidewall within a distance of less than half the height dimension from the transmissive output window.

15. The LED based illumination device of claim 12, wherein the first interior surface includes a first wavelength converting material, and wherein the second interior surface includes a second wavelength converting material.

16. The LED based illumination device of claim 15, wherein a first current is supplied to the first LED, and wherein a second current is supplied to the second LED, and wherein the first current and the second current are selectable to achieve a target color point of light output by the LED based illumination device.

17. The LED based illumination device of claim 12, wherein the first interior surface is a transmissive sidewall, and wherein light output by the LED based illumination device exits the transmissive sidewall.

18. The LED based illumination device of claim 12, wherein the shaped reflector includes a parabolic shaped surface profile.

19. The LED based illumination device of claim 12, wherein the shaped reflector includes an elliptically shaped surface profile.

20. The LED based illumination device of claim 19, wherein a focal point of the elliptically shaped surface profile is approximately located on a surface of the first interior surface at a location that is closer to the second interior surface than to the first LED.

21. The LED based illumination device of claim 12, wherein the first LED is located closer to the first interior surface than the second LED.

22. The LED based illumination device of claim 12, wherein the shaped reflector includes a wavelength converting material.

23. An LED based illumination device, comprising:

a color conversion cavity comprising a first interior surface including a first wavelength converting material and a second interior surface including a second wavelength converting material;

a shaped reflector in the color conversion cavity;

a first LED mounted to a mounting board, the first LED configured to receive a first current, wherein light emitted from the first LED enters the color conversion cavity and is caused to preferentially illuminate the first interior surface by the shaped reflector; and a second LED mounted to the mounting board, the second LED configured to receive a second current, wherein light emitted from the second LED enters the color conversion cavity and is caused to preferentially illuminate the second interior surface by the shaped reflector, and wherein the first current and the second current are selectable to achieve a range of correlated color temperature (CCT) of light output by the LED based illumination device.

24. The LED based illumination device of claim 23, wherein more than fifty percent of light emitted from the first LED is directed to the first interior surface, and wherein more than fifty percent of light emitted from the second LED is directed to the second interior surface.

25. The LED based illumination device of claim 24, wherein the first interior surface is a reflective sidewall and the second interior surface is a transmissive output window.

26. The LED based illumination device of claim 23, wherein the range of CCT of light output by the LED based illumination device by selecting the first current and the second current is greater than 500 Kelvin.

* * * * *